US012674259B2

(12) United States Patent
Mori et al.

(10) Patent No.: US 12,674,259 B2
(45) Date of Patent: Jul. 7, 2026

(54) SEWING MACHINE AND WIDE TABLE ATTACHABLE TO SEWING MACHINE

(71) Applicant: BROTHER KOGYO KABUSHIKI KAISHA, Nagoya (JP)

(72) Inventors: Hiroki Mori, Anjo (JP); Yuya Tatematsu, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 19/230,549

(22) Filed: Jun. 6, 2025

(65) Prior Publication Data

US 2025/0389070 A1 Dec. 25, 2025

(30) Foreign Application Priority Data

Jun. 20, 2024 (JP) ..... 2024-099795

(51) Int. Cl.

| | |
|---|---|
| ***D05B 75/06*** | (2006.01) |
| ***D05B 3/24*** | (2006.01) |
| ***D05B 69/30*** | (2006.01) |
| ***D05B 77/00*** | (2006.01) |

(52) U.S. Cl.

CPC ..... *D05B 75/06* (2013.01); *D05B 3/243* (2013.01); *D05B 69/30* (2013.01); *D05B 77/00* (2013.01)

(58) Field of Classification Search

CPC . D05B 3/243; D05B 3/04; D05B 3/24; D05B 39/00; D05B 39/005; D05B 73/04; D05B 73/10; D05B 77/00

See application file for complete search history.

(56) References Cited

U.S. PATENT DOCUMENTS

| | | | | | |
|---|---|---|---|---|---|
| 3,188,993 | A * | 6/1965 | Szuba | D05B 77/00 | 112/258 |
| 4,114,548 | A * | 9/1978 | Kasahara | D05B 77/00 | 112/258 |
| 5,476,052 | A * | 12/1995 | Kojima | D05B 73/04 | 292/87 |
| 5,906,168 | A * | 5/1999 | Ito | D05B 77/00 | D15/75 |
| 6,019,052 | A * | 2/2000 | Stucki | D05B 73/04 | 112/102.5 |

(Continued)

FOREIGN PATENT DOCUMENTS

JP 2009-011750 A 1/2009

*Primary Examiner* — Danny Worrell
(74) *Attorney, Agent, or Firm* — Oliff PLC

(57) ABSTRACT

A sewing machine includes a bed including a bed surface extending horizontally. A first side plate extends downward from a part of an outer periphery of the bed surface. The first side plate crosses a longitudinal direction of the bed surface. A second side plate extends downward from another part of the outer periphery of the bed surface. The second side plate crosses a short direction of the bed surface. An auxiliary device is attachable to a first mount portion. The first mount portion is provided at the first side plate. The auxiliary device includes a first extension surface extending horizontally. A wide table is attachable to a second mount portion. The second mount portion is provided at the second side plate. The wide table includes a second extension surface extending horizontally. The wide table has a different shape from the auxiliary device.

20 Claims, 21 Drawing Sheets

(56) References Cited

U.S. PATENT DOCUMENTS

| | | | | |
|---|---|---|---|---|
| 6,293,212 | B1 * | 9/2001 | Ebata | D05B 21/00 112/168 |
| 7,293,514 | B2 * | 11/2007 | Fukao | D05B 73/10 112/260 |
| 7,328,665 | B2 * | 2/2008 | Konig | D05B 21/00 112/470.18 |
| 7,568,441 | B2 * | 8/2009 | Fukao | D05B 3/243 112/168 |
| 8,661,996 | B2 * | 3/2014 | Inoue | D05B 91/12 112/260 |
| 11,873,591 | B2 * | 1/2024 | Oie | D05B 3/243 |
| 2009/0013913 | A1 * | 1/2009 | Nonobe | D05B 3/243 112/260 |

* cited by examiner

SEWING MACHINE AND WIDE TABLE ATTACHABLE TO SEWING MACHINE

REFERENCE TO RELATED APPLICATIONS

This application claims priority from Japanese Patent Application No. 2024-099795 filed on Jun. 20, 2024. The entire content of the priority application is incorporated herein by reference.

BACKGROUND ART

A sewing machine to which an embroidery device is attachable is known.

SUMMARY

A cover for an embroidery device of a sewing machine includes a planar portion, an engagement portion, a support leg, a peripheral wall portion, and a locking portion. The planar portion forms a substantially horizontal plane integrally with a bed and a free arm in a state where the cover for the embroidery device is attached to the sewing machine. The engagement portion engages with the sewing machine. The support leg is movable between a substantially vertical position and a substantially horizontal position. The support leg supports a main body in the substantially vertical position, and covers the embroidery device in the substantially horizontal position. The peripheral wall portion covers a transfer mechanism and a slit to protect the same from dust and so on in a state of covering the embroidery device. The locking portion is locked to the embroidery device. The cover for the embroidery device is usable as an auxiliary table in a state of being attached to the sewing machine, and is usable as the cover for the embroidery device in a state of covering the embroidery device.

There is a demand for sewing workpieces of various sizes even in a state where an embroidery device or an auxiliary table is attached to a sewing machine. However, in known sewing machines, there is a possibility that convenience is reduced when sewing a sewing workpiece larger than a bed surface.

In view of the foregoing, an example of an object of this disclosure is to provide a sewing machine and a wide table attachable to a sewing machine, which improves convenience when sewing a sewing workpiece larger than a bed surface.

According to a first aspect, this specification discloses a sewing machine. The sewing machine includes a bed. The bed includes a bed surface, a first side plate, a second side plate, a first mount portion, and a second mount portion. The bed surface extends horizontally. The first side plate extends downward from a part of an outer periphery of the bed surface. The first side plate crosses a longitudinal direction of the bed surface. The second side plate extends downward from another part of the outer periphery of the bed surface. The second side plate crosses a short direction of the bed surface. An auxiliary device is attachable to the first mount portion. The first mount portion is provided at the first side plate. The auxiliary device includes a first extension surface extending horizontally. A wide table is attachable to the second mount portion. The second mount portion is provided at the second side plate. The wide table includes a second extension surface extending horizontally. The wide table has a different shape from the auxiliary device. The sewing machine of the first aspect contributes to attaching the auxiliary device to the first mount portion and attaching the wide table to the second mount portion. That is, the wide table is attachable to the sewing machine in a state where the auxiliary device is attached to the sewing machine, and the sewing machine contributes to expanding the bed surface by the second extension surface of the wide table. Thus, the second mount portion of the sewing machine expands the surface on which the user places a sewing workpiece when sewing the sewing workpiece larger than the bed surface, and contributes to improvement of convenience when sewing the sewing workpiece larger than the bed surface.

According to a second aspect, this specification also discloses a wide table attachable to a sewing machine. The wide table includes a table plate, a leg, a lever, and a lock release member. The table plate includes a table surface extending horizontally. The leg is coupled to the table plate. The lever protrudes from the table plate in an insertion direction. The insertion direction is one direction along a short direction of a bed surface of the sewing machine. The bed surface extends horizontally. The lever includes a hook protruding in a first direction. The first direction is one direction along a longitudinal direction of the bed surface. A second direction is an opposite direction along the longitudinal direction. The lever is supported by the table plate so as to be pivotable between a normal position and an attachment-detachment position at which the hook is located farther in the second direction than the normal position. The lever is inserted into an opening of a side plate in the insertion direction. The side plate crosses the short direction and extends downward from an outer periphery of the bed surface. The hook is engageable with a mount portion including an engagement edge by pivoting from the attachment-detachment position to the normal position. The engagement edge defines the opening of the sewing machine. The lock release member is connected to the lever. The lock release member is supported by the table plate so as to be movable from a first position to a second position. The lock release member is configured to, when moved from the first position to the second position, cause the lever to move from the normal position to the attachment-detachment position and release engagement between the hook and the mount portion. The wide table attachable to the sewing machine is attached to the bed when a sewing workpiece larger than the bed surface is sewn, and thus the sewing workpiece is supported by the bed and the wide table. Thus, the wide table contributes to improvement in ease of sewing as compared with a known sewing machine. The wide table is detachably attached to the bed, and thus, the wide table contributes to switching whether to use the wide table depending on the size of the sewing workpiece. Thus, the wide table contributes to both making the sewing machine compact and improving the ease of sewing a relatively large sewing workpiece, compared with a case where the wide table is not detachable from the bed of the sewing machine. The lever of the wide table contributes to performing the operation of engaging the lever with the opening by a relatively simple operation of pivoting the lever from the attachment-detachment position to the normal position. The lock release member of the wide table contributes to performing the operation of pivoting the lever from the normal position to the attachment-detachment position by a relatively simple operation of moving the lock release member from the first position to the second position.

DESCRIPTION

Figure 1:
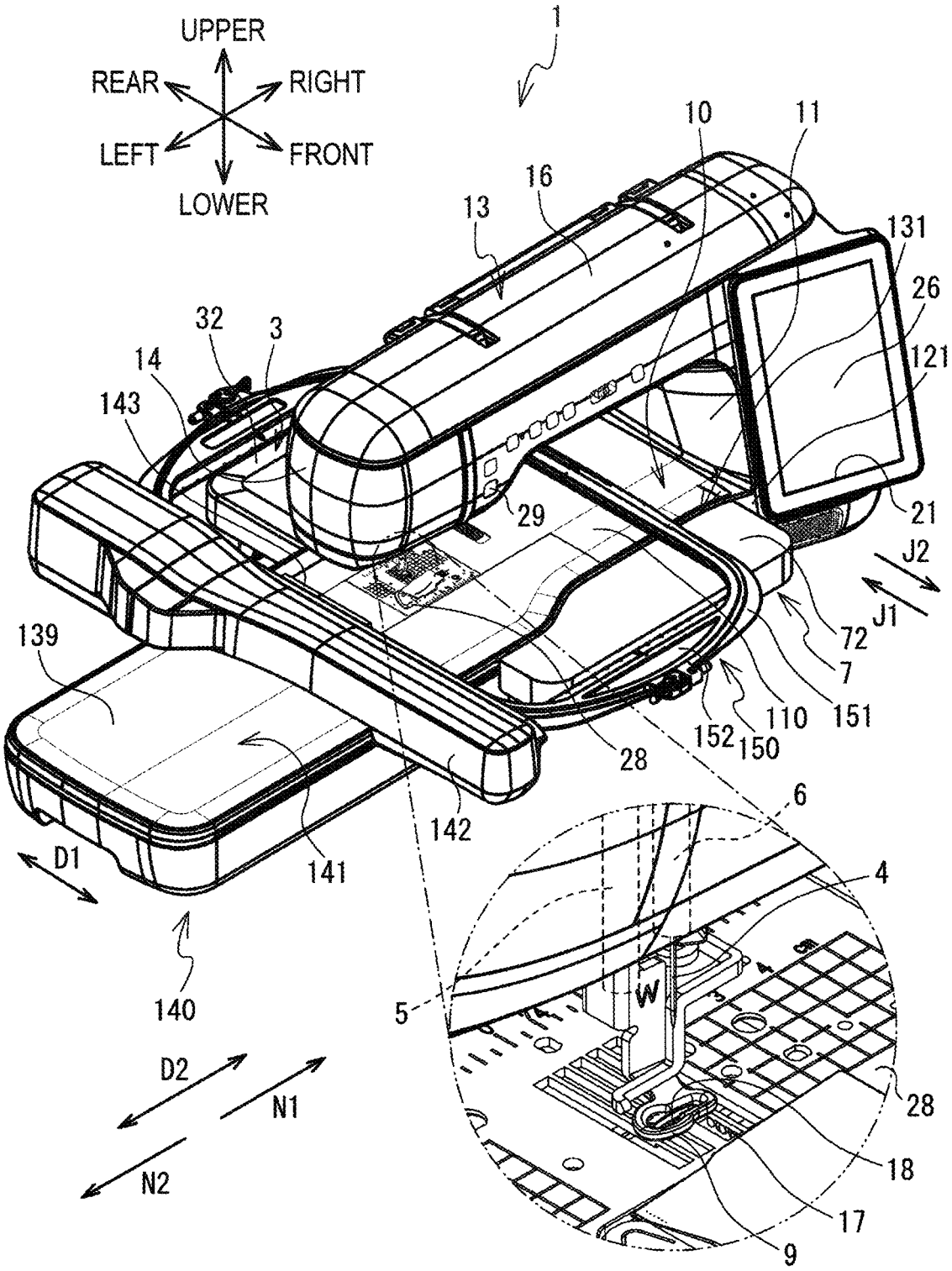
FIG. 1 is a perspective view of a sewing machine 1 to which wide tables 3 and 7 and an embroidery device 140 are attached.

A sewing machine 1 according to an embodiment will be described with reference to the drawings. A structural configuration of the sewing machine 1 to which an embroidery device 140 is attached will be described with reference to FIGS. 1 to 18. The upper-lower direction, the lower right side, the upper left side, the lower left side, and the upper right side in FIG. 1 are respectively the upper-lower direction, the front, the rear, the left, and the right of the sewing machine 1 to which the embroidery device 140 is attached. A longitudinal direction D2 of a bed 10 and an arm 13 is the left-right direction of the sewing machine 1. A short direction D1 of the bed 10 and the arm 13 is the front-rear direction of the sewing machine 1. The side on which a pillar 11 is disposed is the right side. The direction of extension of the pillar 11 is the upper-lower direction of the sewing machine 1. One direction along the longitudinal direction D2 is defined as a first direction N1, and the opposite direction is defined as a second direction N2. In the present embodiment, the first direction N1 is rightward, and the second direction N2 is leftward. One direction along the short direction D1 is defined as an insertion direction K1 of a wide table 3. The opposite direction along the short direction D1 is defined as a detachment direction K2 of the wide table 3. One direction along the short direction D1 is defined as an insertion direction J1 of a wide table 7. The opposite direction along the short direction D1 is defined as a detachment direction J2 of the wide table 7. In the present embodiment, the detachment direction K2 of the wide table 3 and the insertion direction J1 of the wide table 7 are rearward. In the present embodiment, the insertion direction K1 of the wide table 3 and the detachment direction J2 of the wide table 7 are forward.

Figure 2:
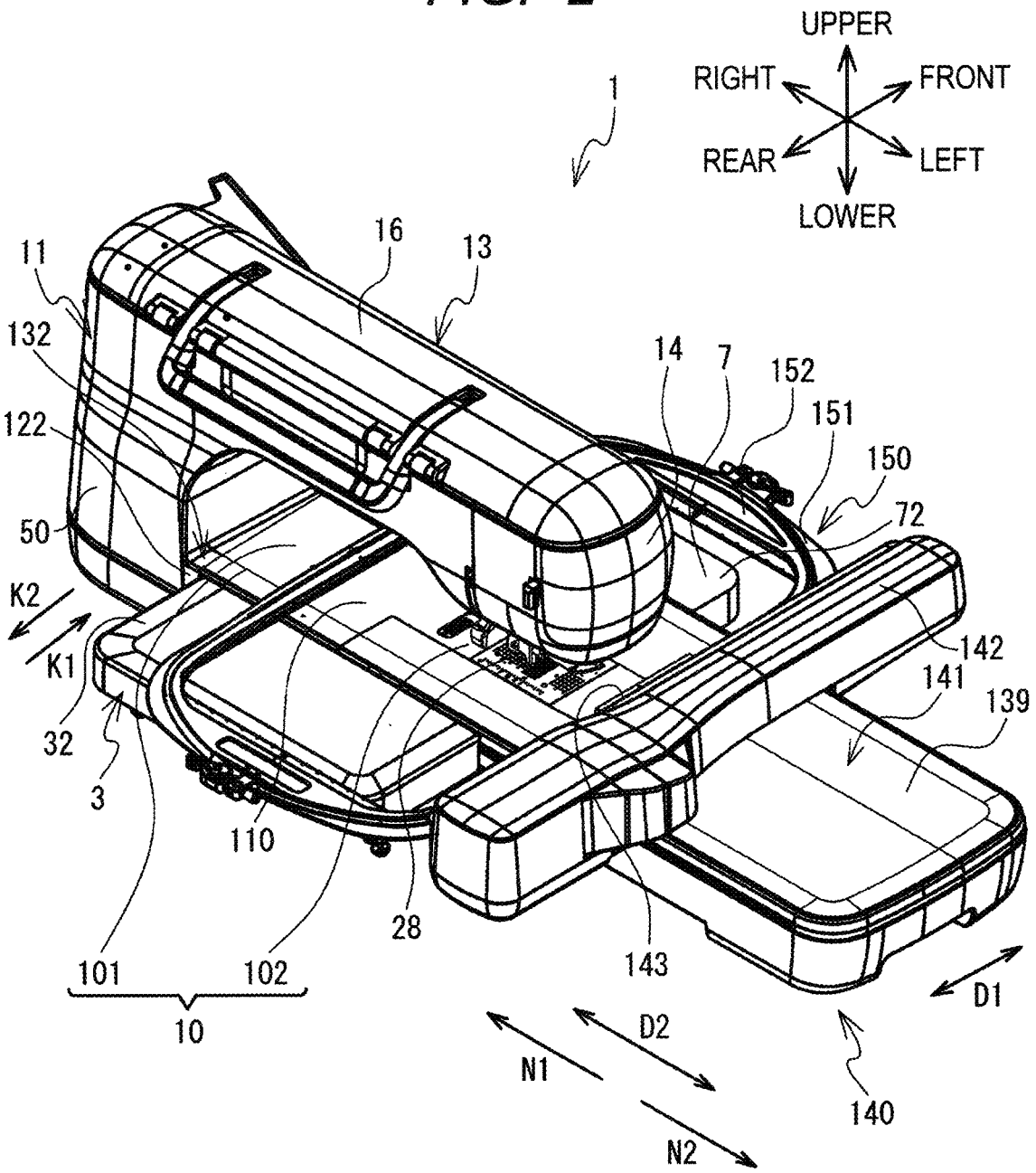
FIG. 2 is a perspective view of the sewing machine 1 to which the wide tables 3 and 7 and the embroidery device 140 are attached.

As shown in FIGS. 1 and 2, the sewing machine 1 includes the bed 10, the pillar (column) 11, the arm 13, a head 14, the embroidery device 140, and the wide tables 3 and 7. The bed 10 extends in the left-right direction, and is a base portion of the sewing machine 1. The pillar 11 extends upright from the right end of the bed 10. The arm 13 extends leftward from the upper end of the pillar 11 so as to face the bed 10. The head 14 is a portion connected to the left end of the arm 13.

The bed 10 includes a needle plate 28 on a bed surface 110. The needle plate 28 is formed with a needle hole 18 through which a sewing needle 4 described later is inserted. The sewing machine 1 includes a feed dog 17, a feed mechanism (not shown), and a hook mechanism inside the bed 10. The feed dog 17 is driven by the feed mechanism during normal sewing that is not embroidery sewing, and moves a sewing workpiece in a forward feed direction or a reverse feed direction by a particular movement amount. In this example, the forward feed direction is rearward, and the reverse feed direction is forward. The hook mechanism entwines an upper thread (not shown) with a lower thread below the needle plate 28.

Figure 3:
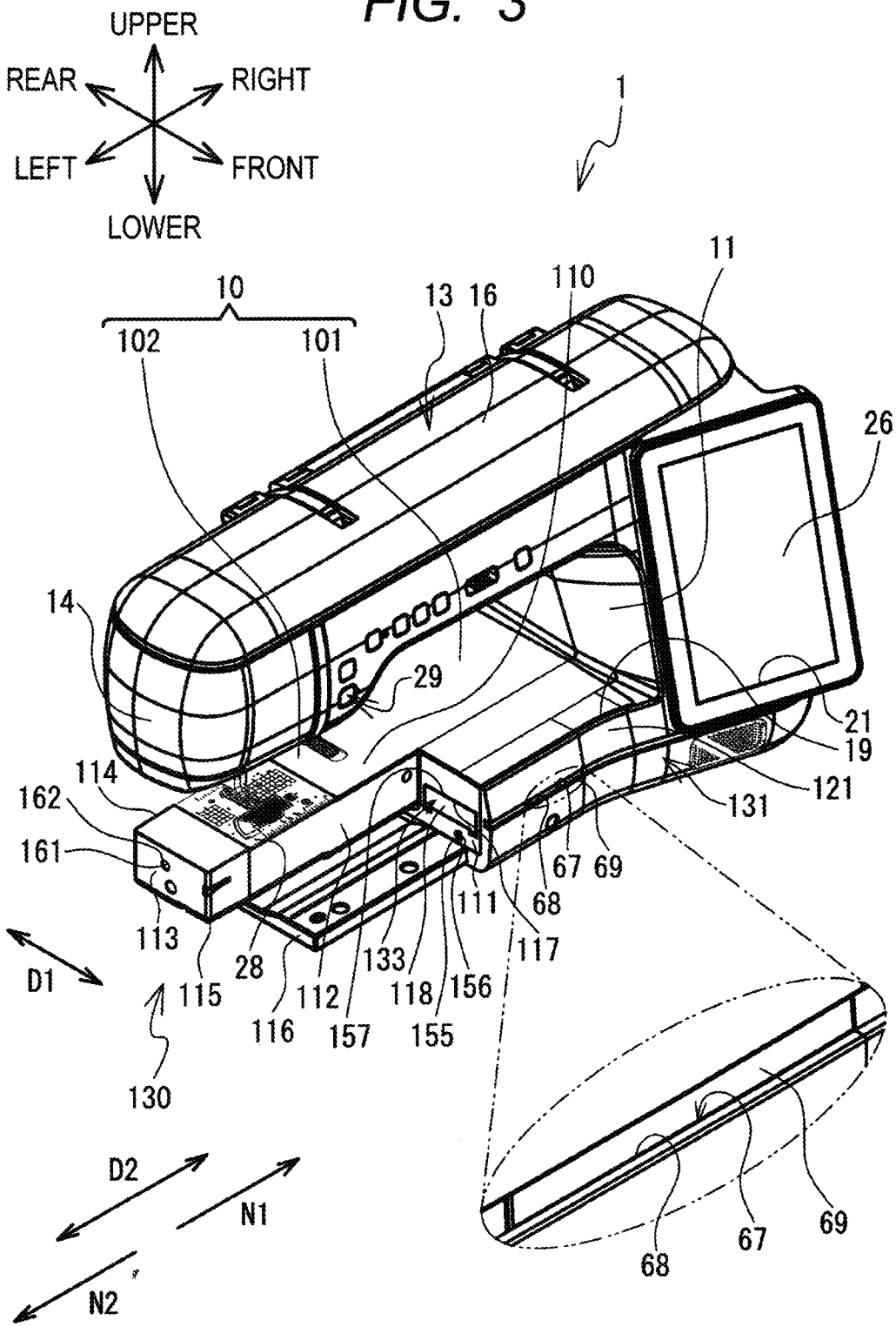
FIG. 3 is a perspective view of the sewing machine 1 from which the wide tables 3 and 7 and the embroidery device 140 have been detached.
Figure 4:
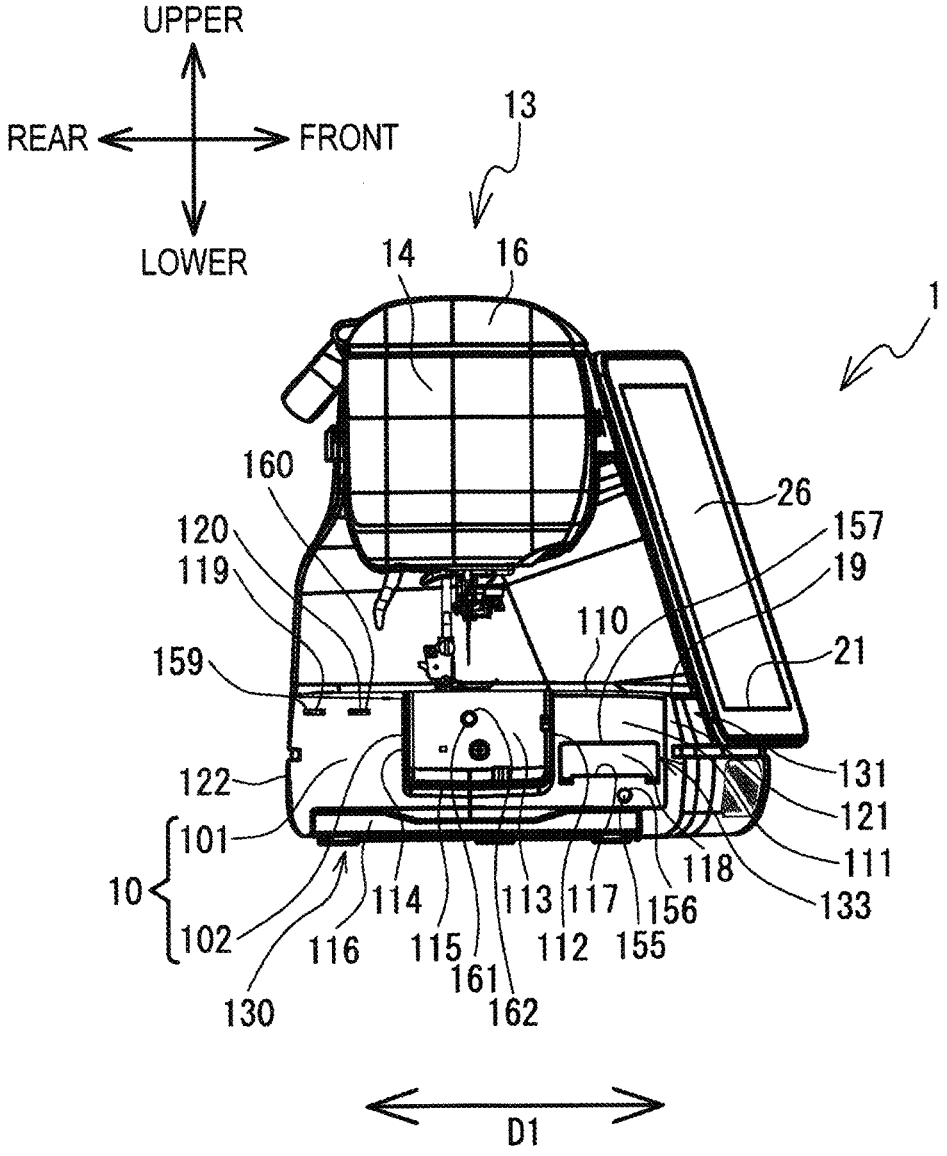
FIG. 4 is a left side view of the sewing machine 1 from which the wide tables 3 and 7 and the embroidery device 140 have been detached.

As shown in FIGS. 2 to 4, the bed 10 includes a base portion 101 connected to the pillar 11 and a free arm 102 extending leftward from a substantially central portion of the left end of the base portion 101. The dimension of the free arm 102 in the front-rear direction is shorter than the dimension of the base portion 101 in the front-rear direction. The height of the upper surface of the base portion 101 is the same as the height of the upper surface of the free arm 102.

The bed 10 includes the bed surface 110, first side plates 111, 113, plates 112, 114, 115, 116, second side plates 121, 122, a first mount portion 130, a connection portion 133, and second mount portions 131, 132. The bed surface 110 is an upper surface of the bed 10 and extends horizontally, that is, in a direction perpendicular to the upper-lower direction. The bed surface 110 is formed by the upper surface of the base portion 101 and the upper surface of the free arm 102. The needle plate 28 is disposed on the upper surface of the free arm 102. The first side plates 111 and 113 extend downward from an outer periphery 19 of the bed surface 110, and cross the longitudinal direction D2 of the bed surface 110. More specifically, each of the first side plates 111 and 113 extends downward from a part of the outer periphery 19. The first side plates 111 and 113 of the present example are perpendicular to the longitudinal direction D2 of the bed surface 110. The first side plate 111 has a U-shape in a left side view and constitutes a left surface of the base portion 101. The first side plate 113 has a rectangular shape in a left side view and constitutes a left surface of the free arm 102. In the longitudinal direction D2, the first side plate 111 is located between the first side plate 113 and the pillar 11.

The first mount portion 130 is configured that an auxiliary device having a first extension surface extending horizontally is attachable. The first mount portion 130 is provided at the first side plates 111 and 113. The auxiliary device is, for example, the embroidery device 140 having a first extension surface 139. The first mount portion 130 includes edges 159, 160, 156, and 162. The edge 159 defines an engagement hole 119. The edge 160 defines an engagement hole 120. The edges 159 and 160 are arranged in the front-rear direction on the first side plate 111 at a position rearward of the free arm 102 and upward of the center of the first side plate 111 in the upper-lower direction. The edge 156 defines an engagement hole 155. The edge 156 is provided on the first side plate 111 at a position forward of the free arm 102. The edge 156 is located below the connection portion 133. The edge 162 defines an engagement hole 161 formed in the left surface of the free arm 102.

The connection portion 133 is provided on the first side plate 111 at a position forward of the free arm 102 and above the edge 156. The connection portion 133 has a connector therein that is electrically connected to a connector 49 of the embroidery device 140 shown in FIG. 5. The connector of the connection portion 133 is provided to control an operation of the embroidery device 140. The connection portion 133 includes an edge 157 and a cover 118. The edge 157 defines an opening 117 formed forward of the free arm 102. The cover 118 closes the opening 117 in a case where the embroidery device 140 is not attached to the bed 10.

The plate 112 constitutes a front surface of the free arm 102. The plate 114 constitutes a rear surface of the free arm 102. The plate 115 constitutes a lower surface of the free arm 102. The plate 116 extends horizontally below the free arm 102.

The second side plates 121 and 122 extend downward from the outer periphery 19 of the bed surface 110. More specifically, each of the second side plates 121 and 122 extends downward from another part of the outer periphery 19, which is a part different from the part of the outer periphery 19 from which the first side plates 111 and 113 extend. The second side plates 121 and 122 cross the short direction D1 of the bed surface 110. The second side plates 121 and 122 have curved surfaces substantially perpendicular to the short direction D1 of the bed surface 110. The second side plate 121 constitutes a front surface of the base portion 101. The second side plate 122 constitutes a rear surface of the base portion 101.

As shown in FIG. 2, the second mount portion 132 is configured that the wide table 3 is attachable. The wide table 3 has a shape different from the shape of an auxiliary device attached to the first mount portion 130. As will be described in detail later, the wide table 3 has a second extension surface 32 that extends horizontally. The second mount portion 132 is provided at the second side plate 122.

Figure 6:
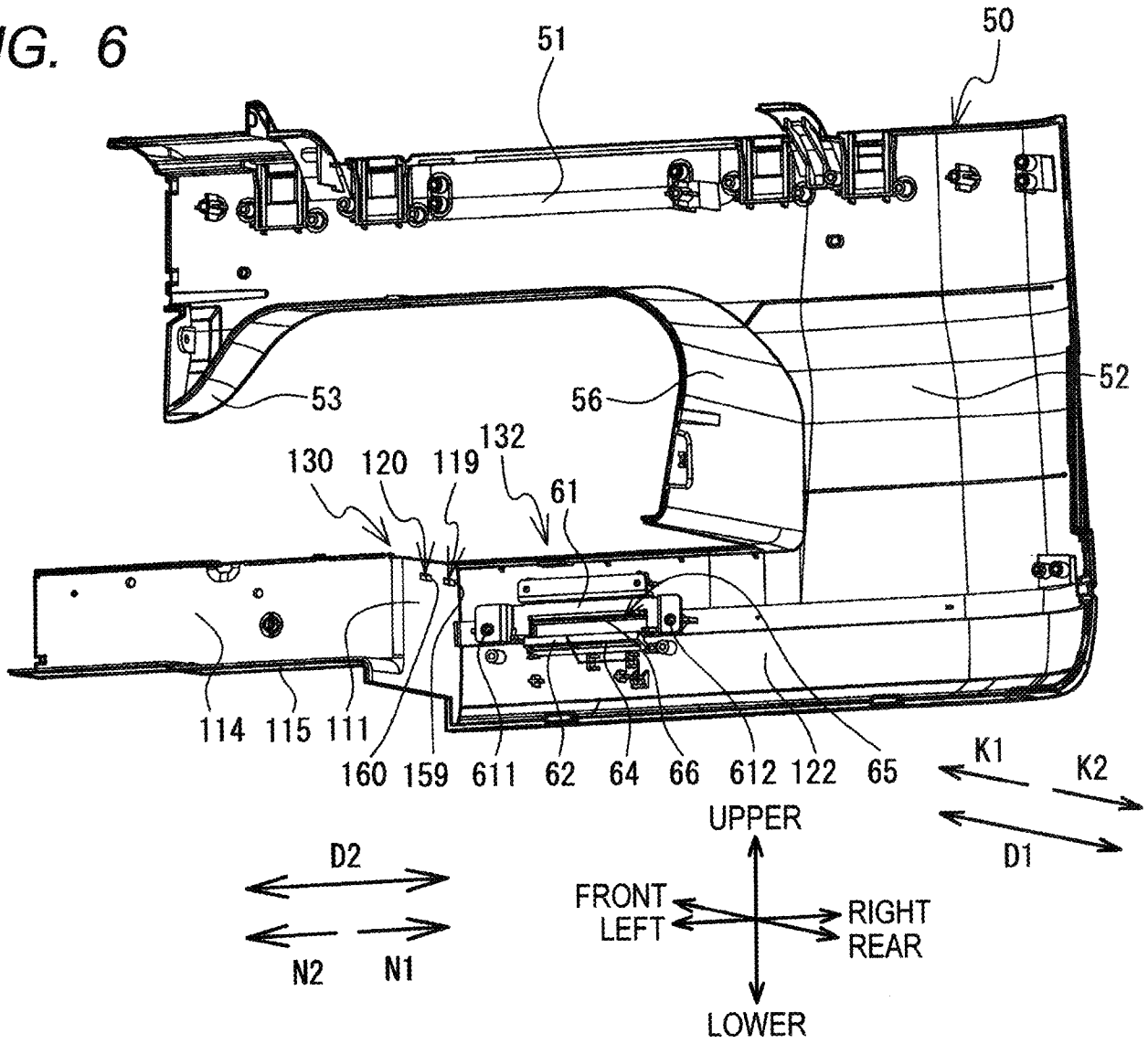
FIG. 6 is a perspective view of a rear-side machine frame 50 of the sewing machine 1.
Figure 7:
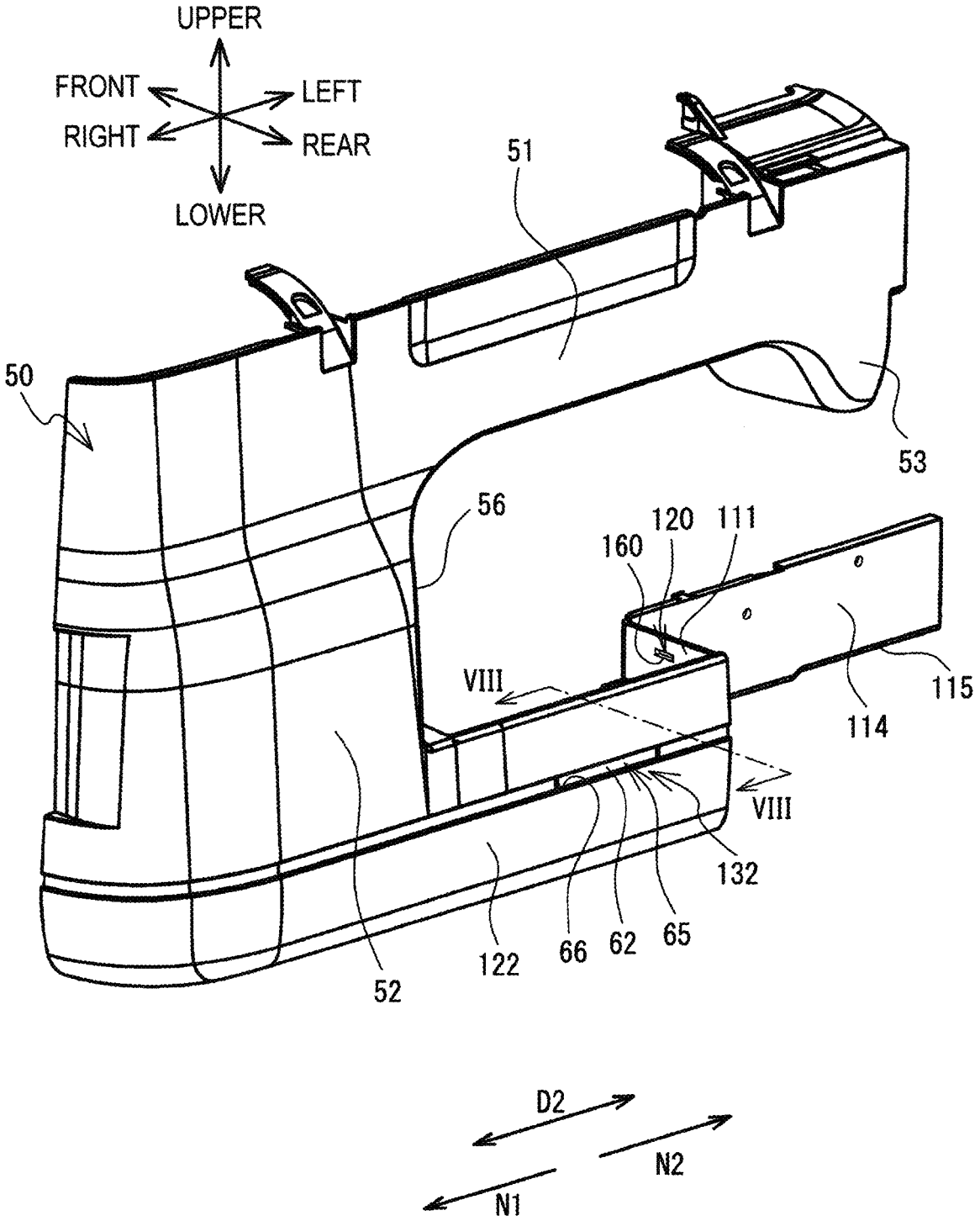
FIG. 7 is a perspective view of the rear-side machine frame 50.

FIGS. 6 and 7 show a rear-side machine frame 50 of the sewing machine 1. The rear-side machine frame 50 includes an arm plate 51, pillar plates 52 and 56, a head plate 53, the second side plate 122, a portion of the first side plate 111, and the plates 114 and 115. The arm plate 51 constitutes a rear surface and a bottom surface of the arm 13. The pillar plate 52 constitutes a rear surface of the pillar 11. The pillar plate 56 constitutes a left surface of the pillar 11. The head plate 53 constitutes a rear surface and a bottom surface of the head 14.

Figure 8A:
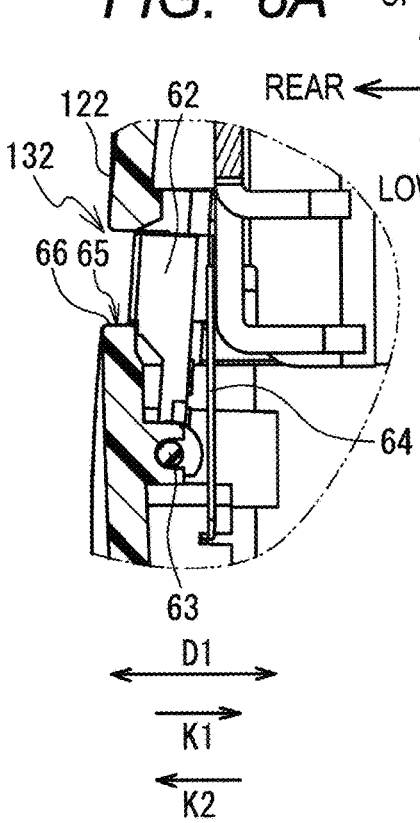
FIG. 8A is an enlarged cross-sectional view taken along a line VIII-VIII of FIG. 7.
Figure 8B:
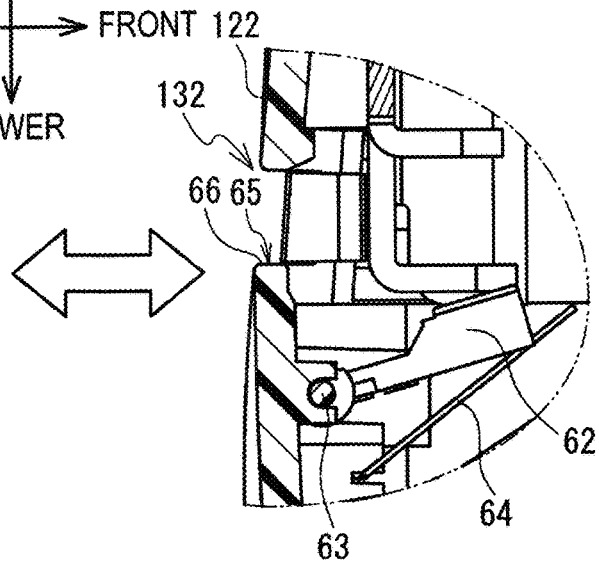
FIG. 8B is an enlarged cross-sectional view taken along the line VIII-VIII of FIG. 7.
Figure 9:
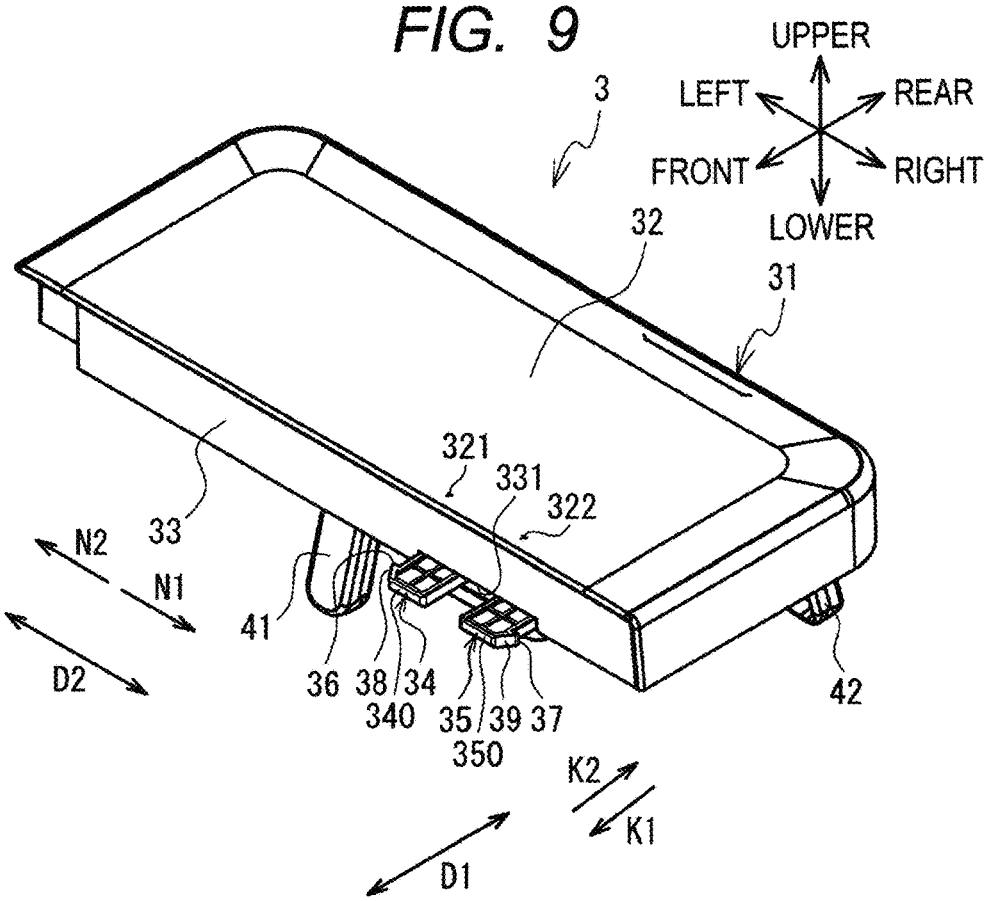
FIG. 9 is a perspective view of the wide table 3.

As shown in FIGS. 6 to 8B, the second mount portion 132 is disposed between the first mount portion 130 and the pillar 11 in the longitudinal direction D2. The second mount portion 132 includes an engagement edge 66, a mount plate 61, a cover 62, and a spring 64. The engagement edge 66 defines an opening 65 formed in the second side plate 122. The engagement edge 66 has a rectangular shape elongated in the left-right direction in a rear view. The engagement edge 66 is disposed at a central portion of the second side plate 122 in the left-right direction. The mount plate 61 is fixed to the periphery of the engagement edge 66 on the front surface of the second side plate 122 by screws 611 and 612. The mount plate 61 is a plate having an inverted U-shape in a front view. The cover 62 closes the opening 65 when the wide table 3 is not attached to the bed 10. The cover 62 is supported by the bed 10 so as to be pivotable about a pivot shaft 63 disposed at the lower end of the cover 62 between a closed position where the cover 62 closes the opening 65 as shown in FIG. 8A and an open position where the cover 62 opens the opening 65 as shown in FIG. 8B. As shown in FIG. 8A, when the cover 62 is at the closed position, the cover 62 extends upward from the pivot shaft 63, and the rear surface of the cover 62 contacts the engagement edge 66. As shown in FIG. 8B, when the cover 62 is at the open position, the cover 62 extends obliquely upward and forward from the pivot shaft 63 and is located below the lower end of the engagement edge 66. The spring 64 is a wire-shaped formed spring. One end of the spring 64 is fixed to the second side plate 122 below the cover 62. The other end of the spring 64 contacts the front surface of the cover 62. The spring 64 urges the cover 62 in a direction in which the cover 62 moves from the open position to the closed position, that is, in the counterclockwise direction in a left side view.

As shown in FIG. 1, the second mount portion 131 is configured that the wide table 7 is attachable. The wide table 7 has a shape different from that of the auxiliary device attached to the first mount portion 130. As will be described in detail later, the wide table 7 has a second extension surface 72 that extends horizontally.

As shown in FIG. 3, the second mount portion 131 is disposed at the second side plate 121. The second mount portion 131 includes an engagement edge 68 that defines an opening 67 formed in the second side plate 121. The engagement edge 68 has a rectangular shape elongated in the left-right direction in a front view. The engagement edge 68 is disposed at a central portion of the second side plate 121 in the left-right direction. The second mount portion 131 is located between the first mount portion 130 and the pillar 11 in the longitudinal direction D2. The second mount portion 131 has a similar configuration to the second mount portion 132, and includes a mount plate (not shown), a cover 69, and a spring (not shown). The cover 69 closes the opening 67 when the wide table 7 is not attached to the bed 10. The cover 69 is supported by the bed 10 so as to be pivotable about a pivot shaft disposed at the lower end of the cover 69 between a closed position where the opening 67 is closed and an open position where the opening 67 is opened. The spring urges the cover 69 in a direction in which the cover 69 moves from the open position to the closed position, that is, in the clockwise direction in a left side view.

As shown in FIG. 1, the pillar 11 extends in the upper-lower direction and is connected to the right end of the bed 10. The pillar 11 includes a sewing machine motor 25 shown in FIG. 19 inside the pillar 11. A liquid crystal display (LCD) 21 is disposed on the front surface of the pillar 11. The LCD 21 displays an image including various items such as commands, illustrations, setting values, and messages. A touch screen 26 configured to detect a pressed position is disposed on the front surface side of the LCD 21. When the user performs a pressing operation on the touch screen 26 by using a pointing body such as a finger or a stylus pen, the touch screen 26 detects a pressed position. A controller 2 of the sewing machine 1 shown in FIG. 19 recognizes the item selected in the image based on the detected pressed position. Hereinafter, the pressing operation of the touch screen 26 by the user is referred to as a panel operation. The user selects a sewing pattern to be sewn and a command to be executed, for example, by the panel operation.

A cover 16 that is opened and closed is disposed at an upper portion of the arm 13. FIG. 1 shows a state where the cover 16 is closed. A main drive shaft (not shown) is disposed inside the arm 13. The main drive shaft extends in the left-right direction, and is rotationally driven by the sewing machine motor 25. Various switches including a start-stop switch 29 are disposed at a left lower portion of the front surface of the arm 13. The start-stop switch 29 is used to start or stop the operation of the sewing machine 1, that is, to input an instruction to start or stop sewing by the user.

A needle bar 6 and a presser bar 5 are disposed at the head 14. The needle bar 6 extends in the upper-lower direction. The needle bar 6 is located above the needle hole 18. The sewing needle 4 is detachably attached to the lower end of the needle bar 6. The needle bar 6 is moved in the upper-lower direction by the rotation of the main drive shaft. A presser foot 9 is detachably attached to the lower end of the presser bar 5. The presser foot 9 is movable together with the presser bar 5 between a lowered position where the presser foot 9 presses the sewing workpiece and a raised position where the presser foot 9 is retracted upward from the lowered position, that is, the presser foot 9 is separated from the sewing workpiece. The presser foot 9 intermittently presses the sewing workpiece downward in conjunction with the up-down movement of the needle bar 6.

The embroidery device 140 is an auxiliary device that includes a horizontally movable holder 143 to which an embroidery frame 150 is attachable. The embroidery device 140 is attached to the first mount portion 130 of the bed 10. The embroidery device 140 includes the holder 143 to which the embroidery frame 150 for holding a sewing workpiece is detachably attached. The embroidery device 140 is configured to move the holder 143 in the front-rear direction and the left-right direction with respect to the needle bar 6. One embroidery frame selected from among a plurality of embroidery frames including the embroidery frame 150 is attachable to the embroidery device 140. The embroidery frame 150 includes a first frame 151 and a second frame 152, and a sheet-like sewing workpiece is held between the first frame 151 and the second frame 152. The sewing workpiece is, for example, a fabric.

Figure 5:
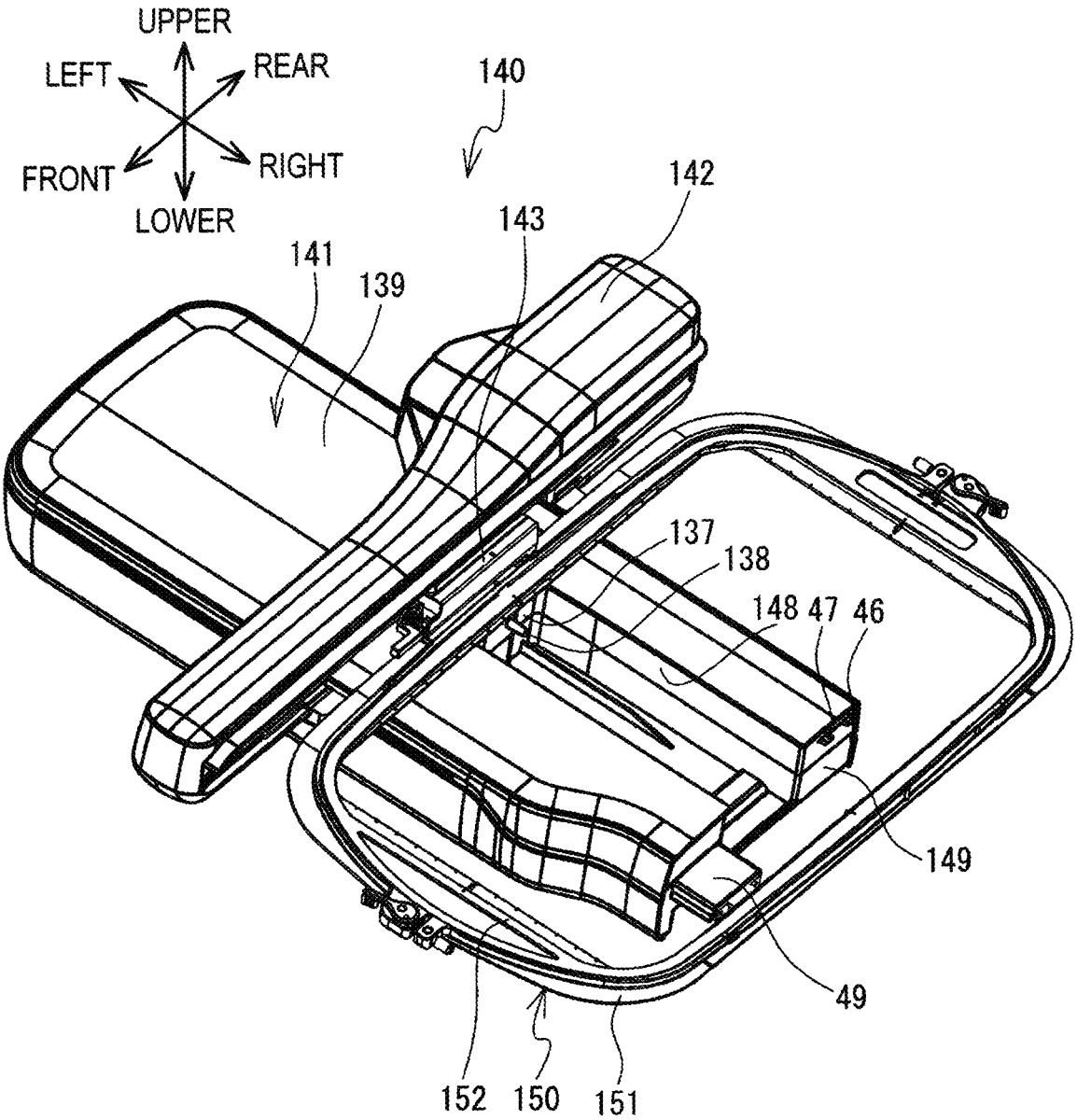
FIG. 5 is a perspective view of the embroidery device 140.

As shown in FIG. 5, the embroidery device 140 includes a main body 141, engagement claws 46 and 47, the connector 49, a carriage 142, and the holder 143. The main body 141 has a rectangular shape that is long in the left-right direction. The dimension of the main body 141 in the front-rear direction is longer than the dimension of the bed 10 in the front-rear direction. The dimension of the main body 141 in the left-right direction is longer than the dimension of the free arm 102 of the bed 10 in the left-right direction. A recess 148 is formed in the main body 141. The recess 148 is recessed leftward from a central portion of a right surface 149 of the main body 141 in the front-rear direction. A cylindrical engagement protrusion 138 protruding rightward is provided on a left surface 137 of the recess 148. When the embroidery device 140 is attached to the bed 10, the engagement protrusion 138 is inserted into the engagement hole 161 of the bed 10, and is detachably engaged with the first mount portion 130, more specifically, the first side plate 113. In a state where the embroidery device 140 is attached to the first mount portion 130, the free arm 102 of the bed 10 is disposed in the recess 148.

The main body 141 has a first extension surface 139 extending horizontally. The first extension surface 139 is an upper surface of the main body 141. In a state where the embroidery device 140 is attached to the first mount portion 130, the first extension surface 139 is on the same plane as the bed surface 110. The main body 141 includes an X movement mechanism 146 and an X motor 144 shown in FIG. 19. The X movement mechanism 146 moves the carriage 142 in the left-right direction, that is, in the X direction. The X motor 144 drives the X movement mechanism 146.

The engagement claws 46 and 47 protrude rightward from the right surface 149 of the main body 141 at a position rearward of the recess 148. The engagement claws 46 and 47 are arranged in the front-rear direction. When the embroidery device 140 is attached to the bed 10, the engagement claw 46 is inserted into the engagement hole 119 and is detachably engaged with the first mount portion 130, more specifically, the first side plate 111. The engagement claw 47 of the embroidery device 140 is inserted into the engagement hole 120 and is detachably engaged with the first mount portion 130, more specifically, the first side plate 111.

The connector 49 protrudes rightward from the right surface 149 at a position forward of the recess 148. When the embroidery device 140 is attached to the bed 10, the connector 49 is electrically connected to a connector provided in the connection portion 133.

Figure 19:
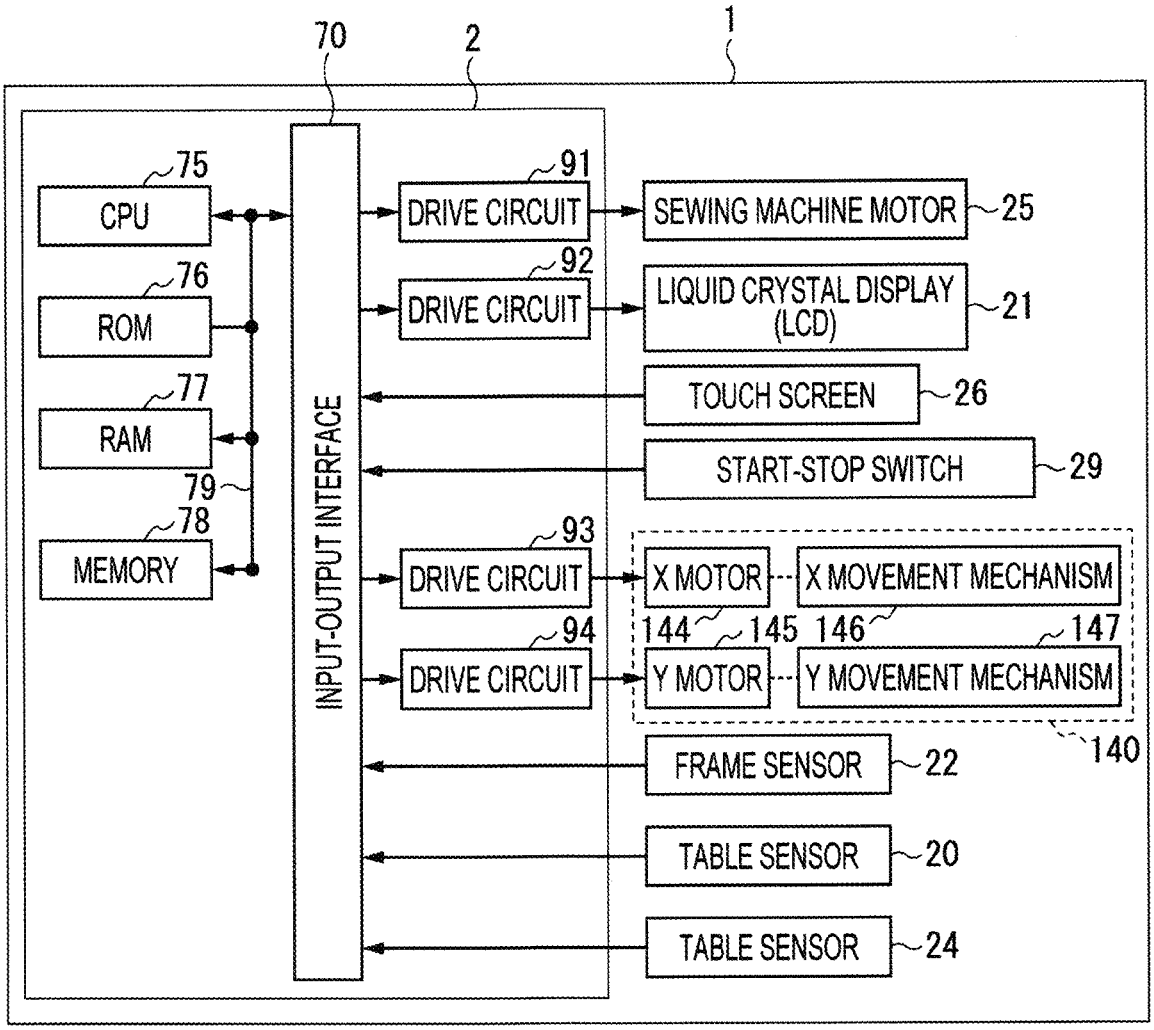
FIG. 19 is a block diagram showing an electrical configuration of the sewing machine 1 to which the embroidery device 140 is attached.

The carriage 142 includes the holder 143, a Y movement mechanism 147, and a Y motor 145 shown in FIG. 19. The holder 143 is disposed on the right side surface of the carriage 142. The Y movement mechanism 147 moves the holder 143 in the front-rear direction, that is, in the Y direction. The Y motor 145 drives the Y movement mechanism 147.

Referring to FIGS. 2 and 9 to 12B, the wide table 3 will be described. As shown in FIG. 2, the wide table 3 is detachably attached to the second mount portion 132 of the bed 10. In a state where the wide table 3 is attached to the bed 10, the wide table 3 is disposed rearward of the bed 10.

As shown in FIGS. 9 to 12B, the wide table 3 includes a table plate 31, legs 41, 42 and 43, a first lever 35, a second lever 34, and a lock release member 45. The table plate 31 is a plate shape that is long in the left-right direction in a plan view. In a state where the wide table 3 is attached to the bed 10, the table plate 31 has a second extension surface 32 that extends horizontally, that is, in a direction perpendicular to the upper-lower direction. The second extension surface 32 is an upper surface of the table plate 31. In a state where the wide table 3 is attached to the bed 10, the second extension surface 32 is on the same plane as the bed surface 110 or is several millimeters (mm) below the bed surface 110. When the embroidering device 140 is attached to the bed 10, the second extension surface 32 of the present example is set to be 2 mm below the bed surface 110. Since the second extension surface 32 is located below the bed surface 110, the second extension surface 32 does not hinder a horizontal movement of the embroidery frame 150. In this case as well, the second extension surface 32 supports the embroidery frame 150 when the embroidery frame 150 is bent downward by the weight of the sewing workpiece. In a case where an auxiliary device 170 or an auxiliary device 200 described later is attached to the bed 10 for performing practical sewing, the second extension surface 32 may be on the same plane as the bed surface 110. The height of the second extension surface 32 in a case where the wide table 3 is attached to the bed 10 may be changeable according to the auxiliary device attached to the bed 10. The difference in height between the bed surface 110 and the second extension surface 32 in a case where the wide table 3 is attached to the bed 10 is within 3 mm or within 2 mm, for example. Marks 321 and 322 are arranged on the second extension surface 32. The marks 321 and 322 indicate the positions of the first lever 35 and the second lever 34 in the left-right direction, respectively. The table plate 31 includes a protrusion 311 that protrudes downward from a lower surface 310 of the table plate 31. The protrusion 311 is disposed rightward of the center of the lower surface 310.

The legs 41, 42 and 43 are coupled to the lower surface 310 of the table plate 31. Each of the legs 41, 42 and 43 is coupled to the table plate 31 so as to be pivotable about a horizontally extending pivot shaft between a use position at which the leg extends vertically and a storage position at which the leg extends horizontally. The leg 41 is supported at a front end portion of the lower surface 310 of the table plate 31 and at the center in the left-right direction so as to be pivotable about a pivot shaft 411 extending in the left-right direction. The leg 42 is supported by a rear right end portion of the lower surface 310 of the table plate 31 so as to be pivotable about a pivot shaft 421 extending in the left-right direction. The leg 43 is supported by a rear left end portion of the lower surface 310 of the table plate 31 so as to be pivotable about a pivot shaft 431 extending in the left-right direction.

The first lever 35 and the second lever 34 protrude in the insertion direction K1, that is, protrude forward from a cutout 331 formed in a front surface 33 of the table plate 31. The insertion direction K1 is one direction along the short direction D1 of the bed surface 110 that extends horizontally in the sewing machine 1. The cutout 331 is recessed upward from the lower end of the front surface 33. The first lever 35 and the second lever 34 are located farther in the first direction N1 than the center of the table plate 31 in the longitudinal direction D2. The first lever 35 and the second lever 34 have plate shapes parallel to the bed surface 110 and elongated in the front-rear direction. The second lever 34 is located leftward of the first lever 35.

The first lever 35 is provided in a bilaterally symmetrical manner with the second lever 34. The first lever 35 includes a pivot shaft 351, a first hook 37, a first inclined portion 39, a first detachment end portion 352, and a spring support portion 353. The pivot shaft 351 extends in the upper-lower direction near the center of the first lever 35 in the front-rear direction. The first lever 35 is supported by the table plate 31 so as to be pivotable about the pivot shaft 351 between a first normal position shown in FIGS. 10A and 12A and a first attachment-detachment position shown in FIGS. 10B and 12B. At the first attachment-detachment position, the first hook 37 is located farther in the second direction N2, that is, farther leftward, than the first hook 37 at the first normal position.

The first hook 37 protrudes from the front end of the first lever 35 in the first direction N1, that is, rightward. The first inclined portion 39 is located between the first hook 37 and the front end of the first lever 35, that is, an end 350 of the first lever 35 in the insertion direction K1. The first inclined portion 39 is inclined in the longitudinal direction D2, more specifically, inclined leftward toward the front. The first detachment end portion 352 is an end portion of the first lever 35 in the detachment direction K2. A left portion of the first detachment end portion 352 protrudes leftward and contacts a protrusion 456 of the lock release member 45 described later. The spring support portion 353 is a hook disposed at an end of the first lever 35 in the detachment direction K2. The spring support portion 353 supports the right end of a spring 30. The spring 30 is a coil spring. The first lever 35 is urged by the spring 30 in the clockwise direction in a bottom view about the pivot shaft 351. The first lever 35 is inserted into the opening 65 and then the first lever 35 pivots from the first attachment-detachment position to the first normal position, whereby the first hook 37 engages with the second mount portion 132.

The second lever 34 includes a pivot shaft 341, a second hook 36, a second inclined portion 38, a second detachment end portion 342, and a spring support portion 343. The pivot shaft 341 extends in the upper-lower direction near the center of the second lever 34 in the front-rear direction. The second lever 34 is supported by the table plate 31 so as to be pivotable about the pivot shaft 341 between a second normal position shown in FIGS. 10A and 12A and a second attachment-detachment position shown in FIGS. 10B and 12B. At the second attachment-detachment position, the second hook 36 is located farther in the first direction N1, that is, farther rightward, than the second hook 36 at the second normal position.

The second hook 36 protrudes from the front end of the second lever 34 in the second direction N2, that is, leftward. The second inclined portion 38 is located between the second hook 36 and an end 340 of the second lever 34 in the insertion direction K1, that is, the front end of the second lever 34. The second inclined portion 38 is inclined in the longitudinal direction D2, more specifically, inclined rightward toward the front. The second detachment end portion 342 is an end portion of the second lever 34 in the detachment direction K2. A right portion of the second detachment end portion 342 protrudes rightward and contacts the protrusion 456 of the lock release member 45 described later. The spring support portion 343 is a hook provided at an end of the second lever 34 in the detachment direction K2, that is, at the rear end. The spring support portion 343 supports the left end of the spring 30. The second lever 34 is urged by the spring 30 in the counterclockwise direction in a bottom view about the pivot shaft 341. The second lever 34 is inserted into the opening 65 of the second mount portion 132 and then pivots from the second attachment-detachment position to the second normal position, whereby the second hook 36 engages with the second mount portion 132.

The lock release member 45 is connected to the first lever 35 and the second lever 34. The lock release member 45 is supported by the lower surface 310 of the table plate 31 so as to be movable from a first position shown in FIGS. 10A and 12A to a second position shown in FIGS. 10B and 12B. The lock release member (lock release plate) 45 has a plate shape parallel to the bed surface 110 of the table plate 31. The lock release member 45 and the table plate 31 sandwiches the first lever 35 and the second lever 34 in the upper-lower direction. The lock release member 45 includes a base plate 451 and the protrusion 456. The protrusion 456 protrudes upward from the upper surface of a front portion of the base plate 451 in a cylindrical shape. The protrusion 456 contacts each of the first detachment end portion 352 of the first lever 35 and the second detachment end portion 342 of the second lever 34. A hole 455 formed through the upper-lower direction is formed at a rear portion of the base plate 451. The base plate 451 functions as a handle that is operated by a user with his or her finger inserted into the hole 455.

Figure 10A:
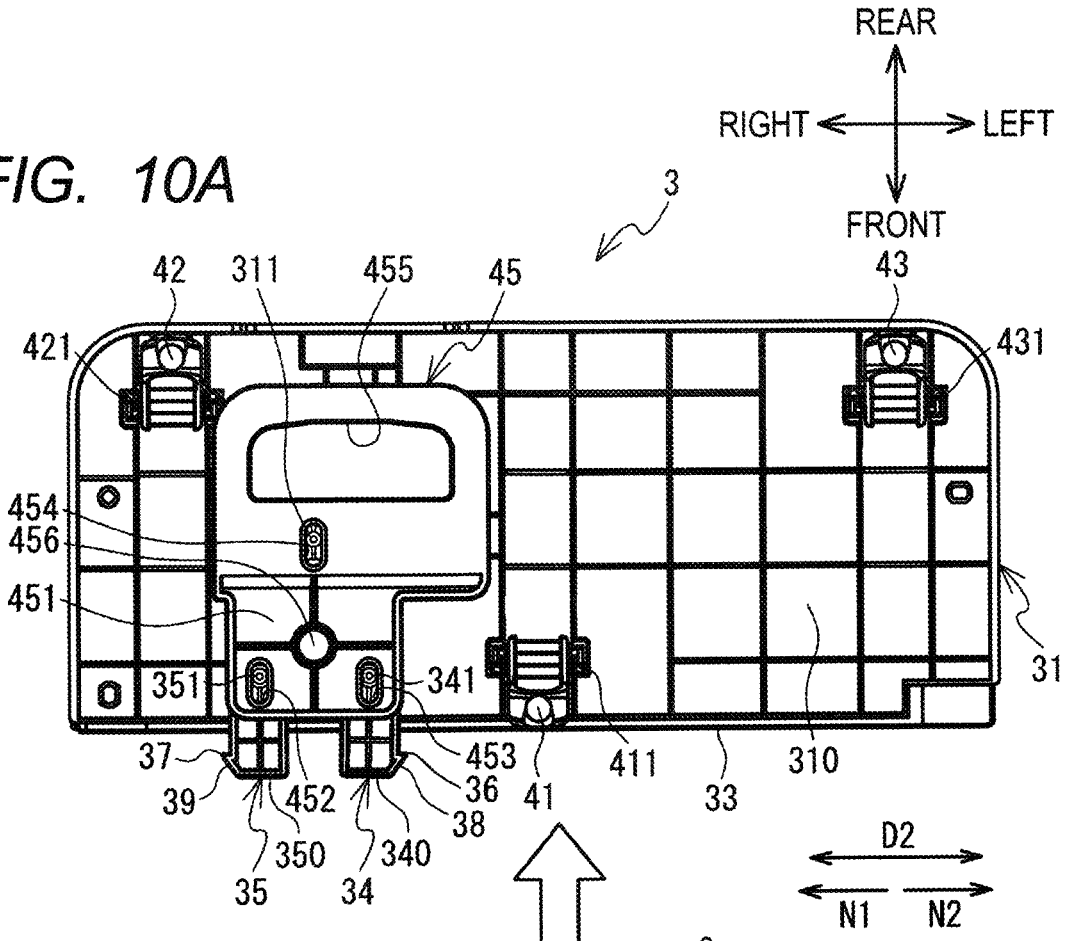
FIG. 10A is a bottom view of the wide table 3.
Figure 10B:
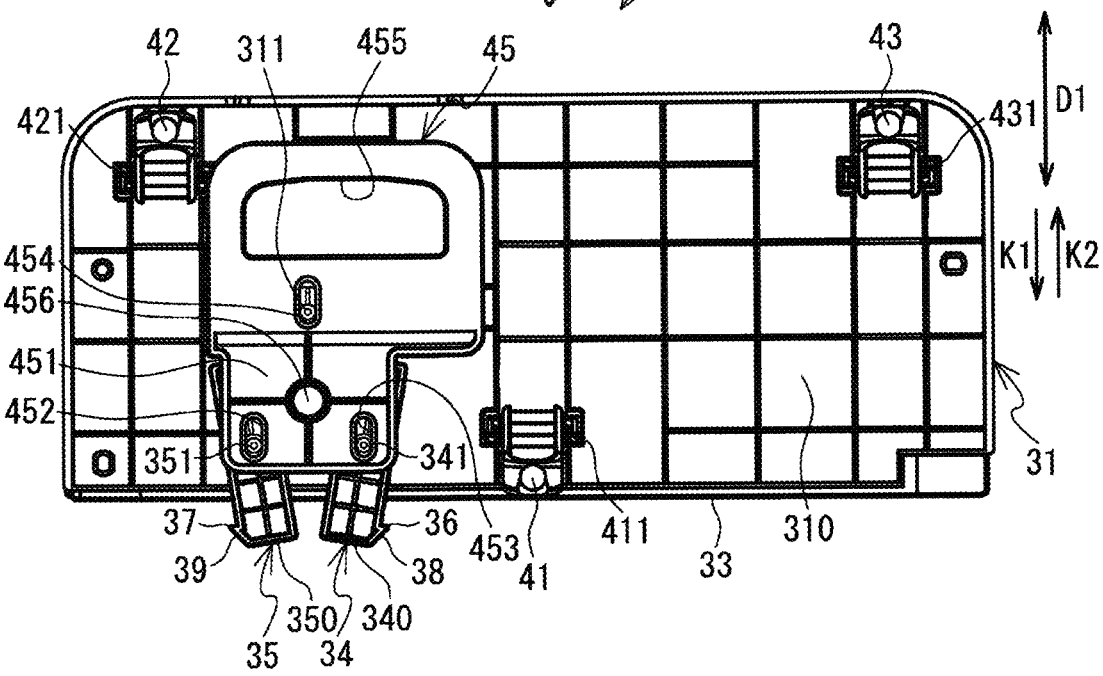
FIG. 10B is a bottom view of the wide table 3.

Elongated holes 452, 453 and 454 which are long in the front-rear direction are formed in the base plate 451. The elongated hole 452 is formed in a front right portion of the base plate 451, and the pivot shaft 351 is inserted into the elongated hole 452. The elongated hole 453 is formed in a front left portion of the base plate 451, and the pivot shaft 341 is inserted into the elongated hole 453. The elongated hole 454 is formed in a center portion of the base plate 451, and the protrusion 311 is inserted into the elongated hole 454. The elongated holes 452, 453 and 454 guide the movement of the lock release member 45 between the first position and the second position. FIG. 10A is a bottom view of the wide table 3 when the lock release member 45 is at the first position, the first lever 35 is at the first normal position, and the second lever 34 is at the second normal position. FIG. 10B is a bottom view of the wide table 3 when the lock release member 45 is at the second position, the first lever 35 is at the first attachment-detachment position, and the second lever 34 is at the second attachment-detachment position. As shown in FIG. 10A, when the lock release member 45 is at the first position, the pivot shaft 351 is located at the rear end of the elongated hole 452, the pivot shaft 341 is located at the rear end of the elongated hole 453, and the protrusion 311 is located at the rear end of the elongated hole 454. As shown in FIG. 10B, the position of the lock release member 45 with respect to the table plate 31 when the lock release member 45 is at the second position is farther rearward than the position of the lock release member 45 with respect to the table plate 31 when the lock release member 45 is at the first position. When the lock release member 45 is at the second position, the pivot shaft 351 is located at the front end of the elongated hole 452, the pivot shaft 341 is located at the front end of the elongated hole 453, and the protrusion 311 is located at the front end of the elongated hole 454.

Figure 11:
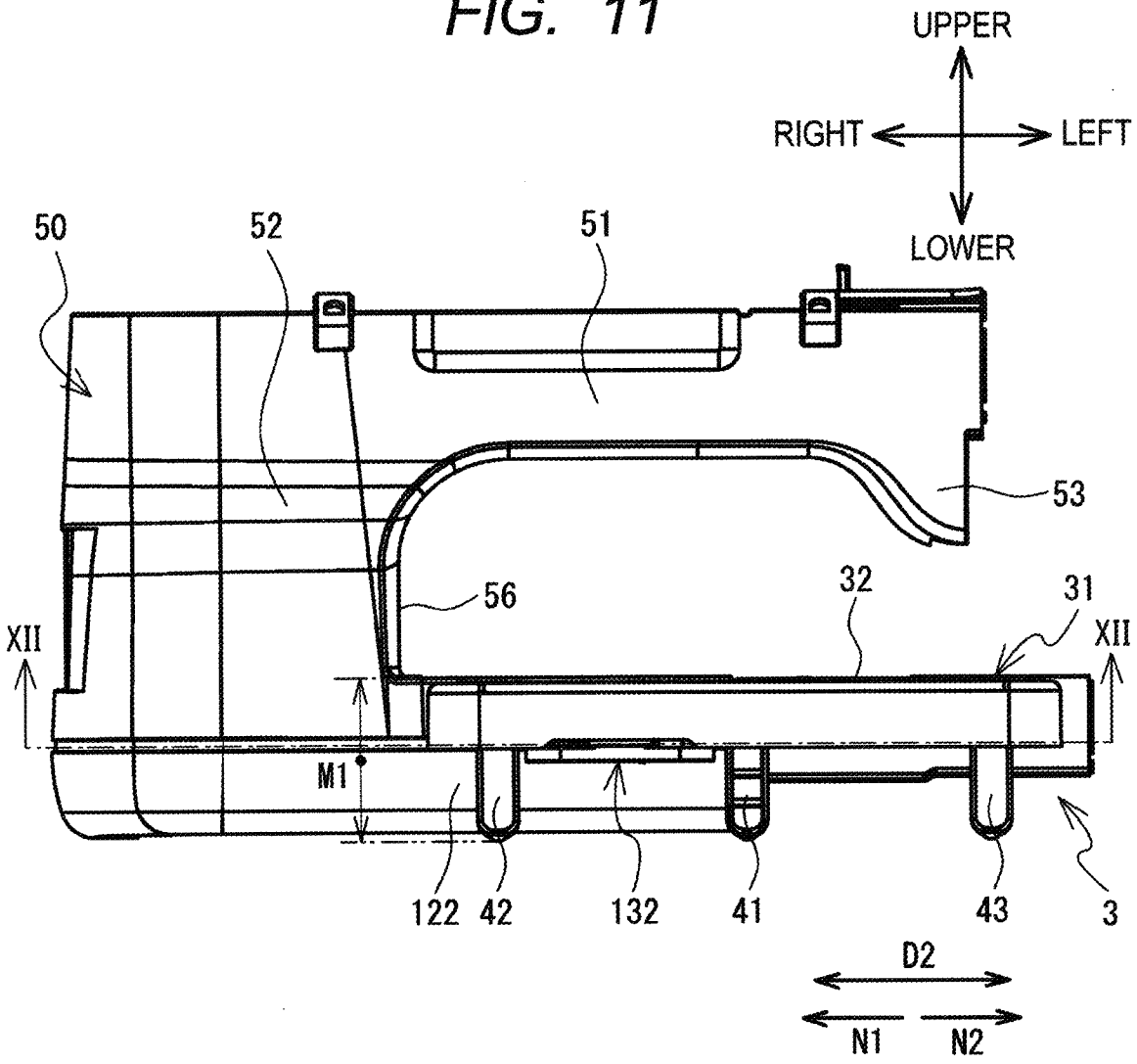
FIG. 11 is a rear view of the sewing machine 1 in a state where the wide table 3 is attached to the rear-side machine frame 50 of the sewing machine 1.
Figure 12A:
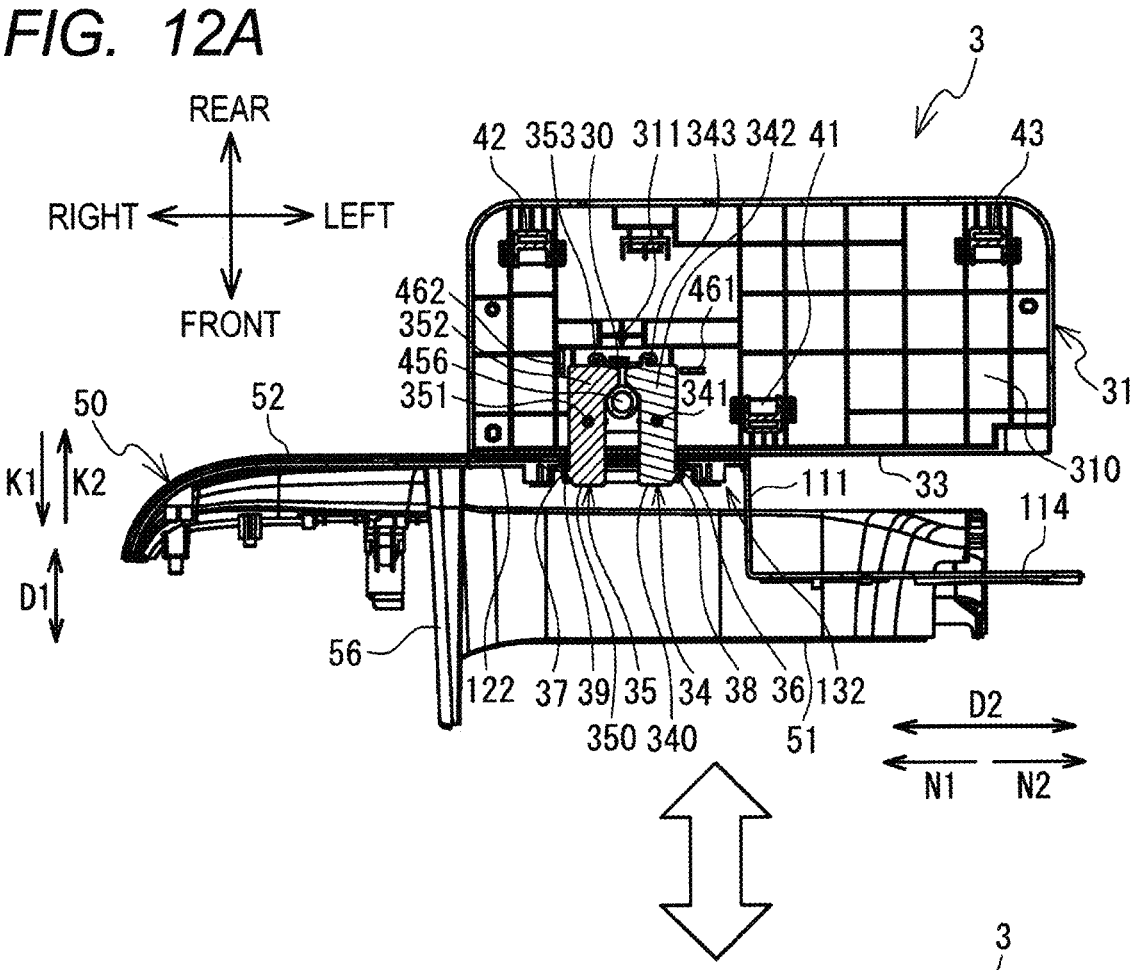
FIG. 12A is a bottom view of the wide table 3.
Figure 12B:
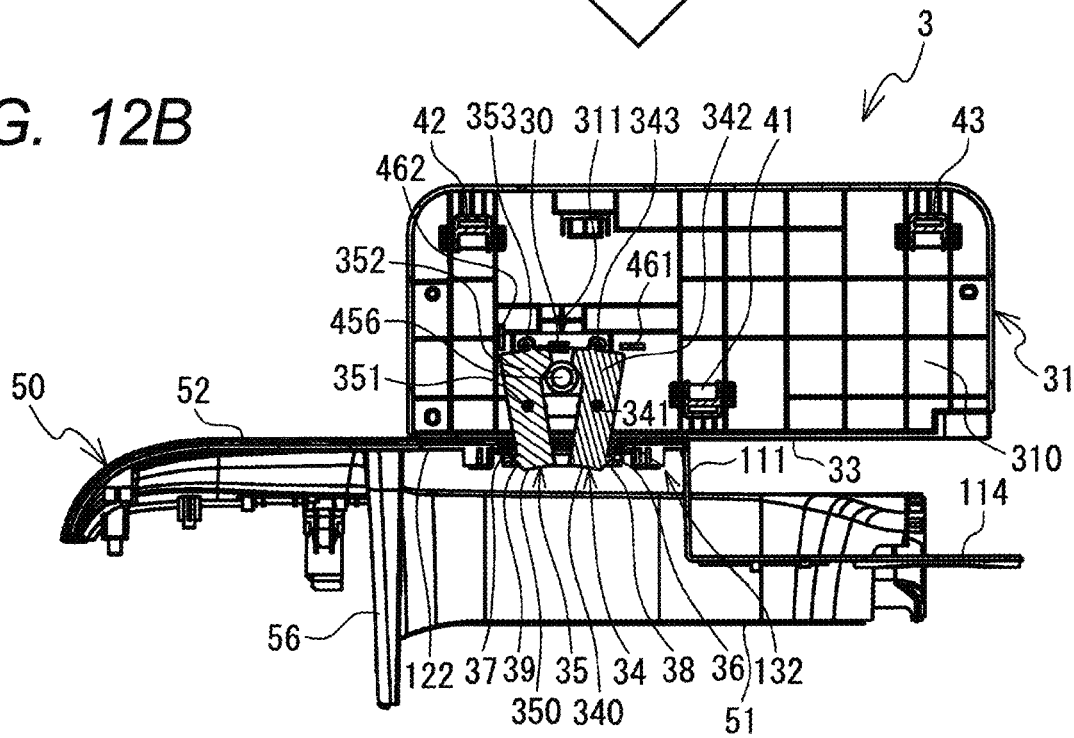
FIG. 12B is a bottom view of the wide table 3.

FIG. 12A is a bottom view of the wide table 3 when the lock release member 45 is at the first position, the first lever 35 is at the first normal position, and the second lever 34 is at the second normal position, corresponding to a cross-sectional view taken along a line XII-XII in FIG. 11. FIG. 12B is a bottom view of the wide table 3 when the lock release member 45 is at the second position, the first lever 35 is at the first attachment-detachment position, and the second lever 34 is at the second attachment-detachment position, corresponding to a cross-sectional view taken along the line XII-XII in FIG. 11. As shown in FIG. 12A, the wide table 3 includes a first protrusion 462 and a second protrusion 461. The first protrusion 462 and the second protrusion 461 of the present embodiment protrude upward from the upper surface of the lock release member 45. When the first lever 35 is located at the first normal position and the wide table 3 is moved in the first direction N1 with respect to the bed 10, the first protrusion 462 contacts the first detachment end portion 352 of the first lever 35. More specifically, when the first lever 35 is located at the first normal position and the wide table 3 is moved in the first direction N1 with respect to the bed 10, a portion close to the end 350 of the first lever 35 in the insertion direction K1 contacts and is pressed by the engagement edge 66 (the edge in the first direction N1) of the second mount portion 132, and the first lever 35 pivots counterclockwise in the bottom view (FIG. 12A) about the pivot shaft 351. At this time, the first detachment end portion 352 in the detachment direction K2 of the first lever 35 moves in the first direction N1, and thus contacts the first protrusion 462. The first protrusion 462 is located farther in the first direction N1 than the first detachment end portion 352. When the second lever 34 is at the second normal position and the wide table 3 is moved in the second direction N2 with respect to the bed 10, the second protrusion 461 contacts the second detachment end portion 342 of the second lever 34. More specifically, when the second lever 34 is at the second normal position and the wide table 3 is moved in the second direction N2 with respect to the bed 10, a portion close to the end 340 of the second lever 34 in the insertion direction K1 contacts and is pressed by the engagement edge 66 (the edge in the second direction N2) of the second mount portion 132, and the second lever 34 pivots clockwise in the bottom view (FIG. 12A) about the pivot shaft 341. At this time, the second detachment end portion 342 in the detachment direction K2 of the second lever 34 moves in the second direction N2, and thus contacts the second protrusion 461. The second protrusion 461 is located farther in the second direction N2 than the second detachment end portion 342. When a force in the left-right direction is applied to the wide table 3 in a state where the wide table 3 is attached to the bed 10, the second protrusion 461 and the first protrusion 462 prevent the second lever 34 and the first lever 35 from pivoting against the urging force of the spring 30 and rattling. The second protrusion 461 and the first protrusion 462 are configured to restricting pivoting of the second lever 34 and the first lever 35, thereby preventing the wide table 3 from being unintentionally detached.

When the wide table 3 is attached to the bed 10, the user inserts the second lever 34 and the first lever 35 of the wide table 3 into the opening 65 while using the marks 321 and 322 of the second extension surface 32 as a mark in a state where the legs 41 to 43 are arranged at the use position. When the wide table 3 is attached to the bed 10, the cover 62 of the second mount portion 132 is pushed in the insertion direction K1 by the first lever 35 and the second lever 34, and thereby pivots from the closed position to the open position. The first lever 35 is inserted into the opening 65 while the first inclined portion 39 contacts the engagement edge 66, and thus the first lever 35 pivots from the normal position to the attachment-detachment position against the urging force of the spring 30. The second lever 34 is inserted into the opening 65 while the second inclined portion 38 contacts the engagement edge 66, and thus the second lever 34 pivots from the normal position to the attachment-detachment position against the urging force of the spring 30. After the first hook 37 of the first lever 35 and the second hook 36 of the second lever 34 are inserted through the opening 65 in the insertion direction K1, the first lever 35 and the second lever 34 pivot from the attachment-detachment position to the normal position by the urging force of the spring 30. This causes the first hook 37 and the second hook 36 to engage with the second mount portion 132. The lock release member 45 is pushed in the insertion direction K1 by each of the first detachment end portion 352 of the first lever 35 and the second detachment end portion 342 of the second lever 34, and moves from the second position to the first position.

As shown in FIG. 2, when the wide table 3 is attached to the bed 10, the end portion of the wide table 3 in the first direction N1 is located farther in the second direction N2 than the pillar 11 in the longitudinal direction D2. That is, the right end of the wide table 3 is located between the pillar 11 and the first side plate 111 in the longitudinal direction D2. In the longitudinal direction D2, the end portion of the wide table 3 in the second direction N2 is located farther in the second direction N2 than the first side plate 111. That is, the left end of the wide table 3 is located between the first side plate 111 and the first side plate 113 in the longitudinal direction D2. The wide table 3 is disposed rearward of the bed 10 and is not disposed forward of the bed 10. The front surface 33 of the wide table 3 contacts the second side plate 122, and the second extension surface 32 forms a flat surface continuous with the bed surface 110. In a state where the legs 41 to 43 are at the use position, the table plate 31, the first lever 35, and the second lever 34 are located above a center M1 of the wide table 3 in the upper-lower direction. Since the first lever 35 and the second lever 34 engage with the second mount portion 132 of the bed 10 above the center M1 of the wide table 3 in the upper-lower direction, a gap is less likely to be formed between the second extension surface 32 and the bed surface 110, compared with the case where the first lever 35 and the second lever 34 engage with the second mount portion 132 of the bed 10 below the center of the wide table 3 in the upper-lower direction. The wide table 3 is disposed below a rear right portion of the embroidery frame 150, and supports the rear right portion of the embroidery frame 150 when the embroidery frame 150 is bent downward by the weight of the sewing workpiece. Scissors may be placed in a space below the table plate 31, for example.

When the wide table 3 is detached from the bed 10, the user places his or her finger on the hole 455 of the lock release member 45 of the wide table 3 and moves the lock release member 45 rearward. The lock release member 45 is guided by the elongated holes 452 to 454 to move from the first position to the second position. In the process of the lock release member 45 moving from the first position to the second position, the protrusion 456 causes the first lever 35 to pivot counterclockwise in a bottom view against the urging force of the spring 30. The protrusion 456 causes the second lever 34 to pivot clockwise in a bottom view against the urging force of the spring 30. As a result, the protrusion 456 of the lock release member 45 causes the first lever 35 to pivot from the first normal position to the first attachment-detachment position and causes the second lever 34 to pivot from the second normal position to the second attachment-detachment position, thereby releasing the engagement between the first hook 37, the second hook 36 and the second mount portion 132. The user moves the wide table 3 from the bed 10 in the detachment direction K2, pulls out the first lever 35 and the second lever 34 of the wide table 3 from the opening 65, and then releases the lock release member 45. The first lever 35 and the second lever 34 pivot from the attachment-detachment position to the normal position by the urging force of the spring 30. The lock release member 45 is pushed in the insertion direction K1 by each of the first detachment end portion 352 of the first lever 35 and the second detachment end portion 342 of the second lever 34, and moves from the second position to the first position. This configuration allows the user to store the wide table 3 in a compact manner in a state where the legs 41 to 43 are arranged at the storage positions.

Referring to FIGS. 1 and 13 to 15, the wide table 7 will be described. As shown in FIG. 1, the wide table 7 is detachably attached to the second mount portion 131 of the bed 10. In a state where the wide table 7 is attached to the bed 10, the wide table 7 is disposed forward of the bed 10.

Figure 13:
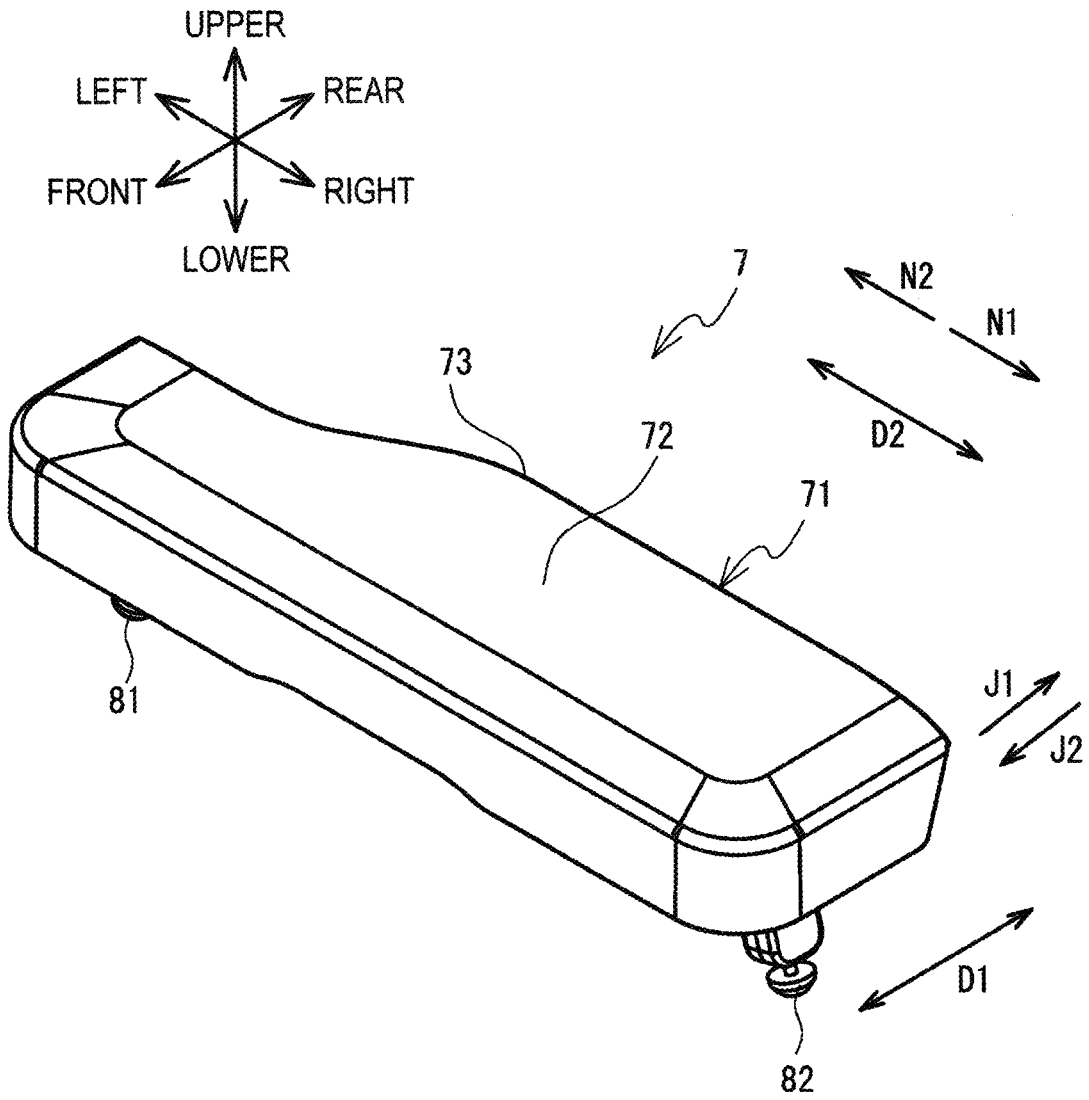
FIG. 13 is a perspective view of the wide table 7.
Figure 14A:
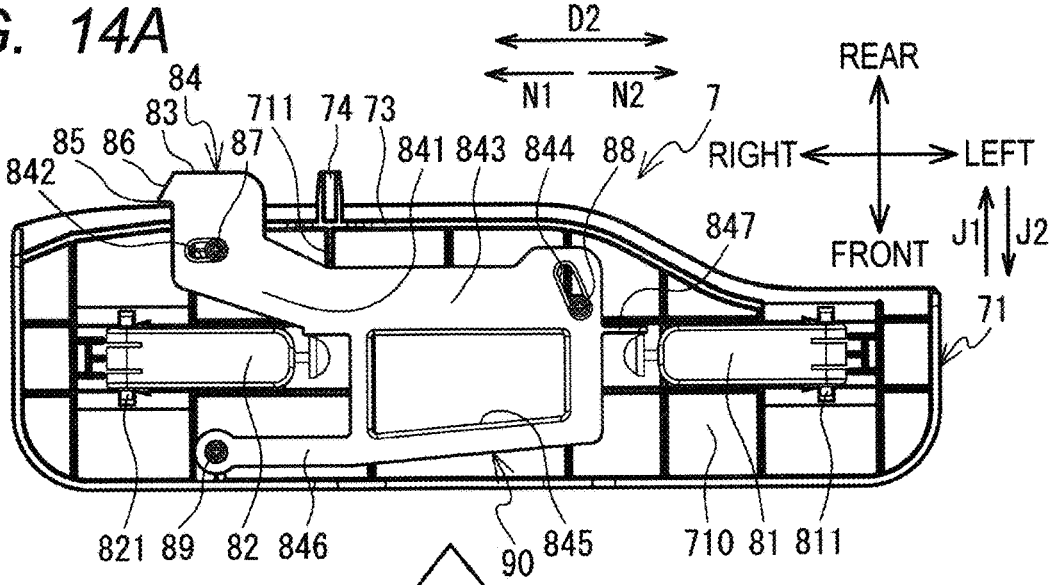
FIG. 14A is a bottom view of the wide table 7.
Figure 14B:
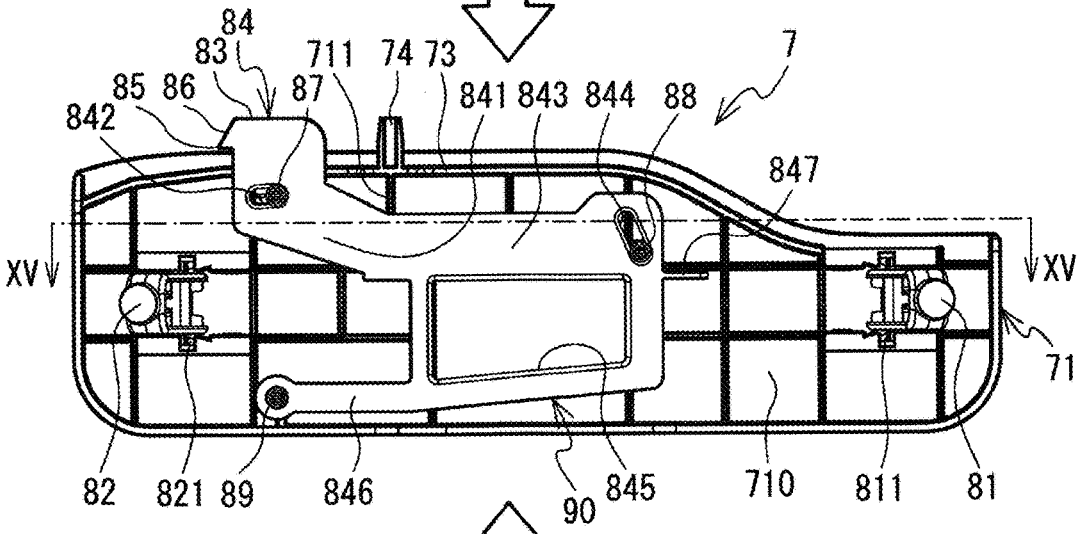
FIG. 14B is a bottom view of the wide table 7.
Figure 14C:
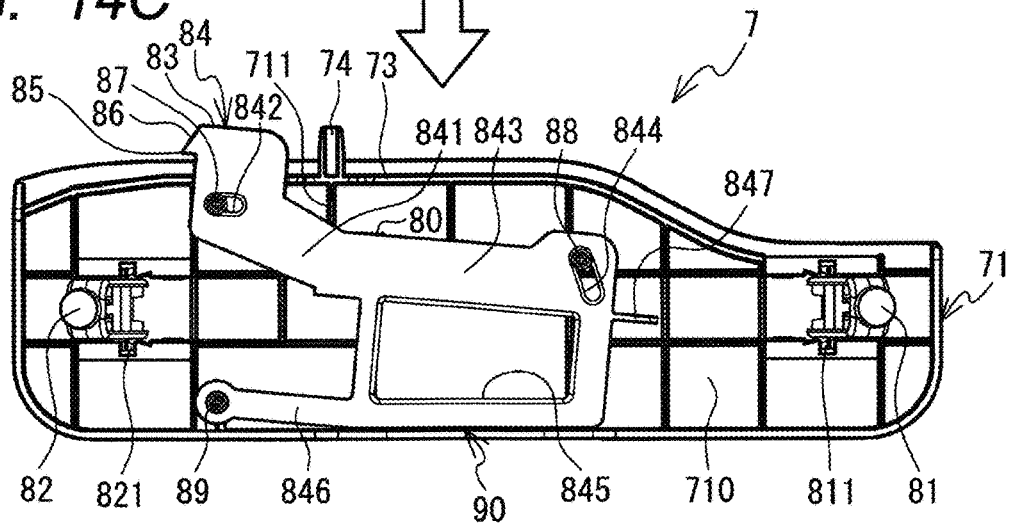
FIG. 14C is a bottom view of the wide table 7.
Figure 15:
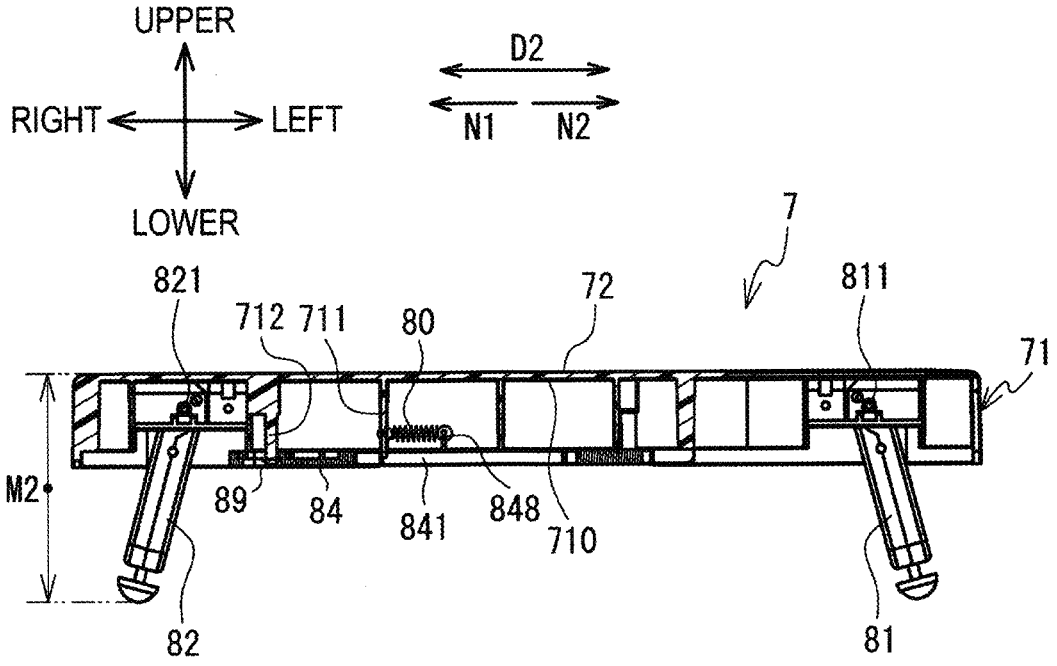
FIG. 15 is a cross-sectional view taken along a line XV-XV of FIG. 14B.

As shown in FIGS. 13 to 15, the wide table 7 includes a table plate 71, legs 81 and 82, a lever 84, a protrusion 74, a lock release member 90, and a spring 80. The table plate 71 has a rectangular shape elongated in the left-right direction in a plan view. The left rear portion of the table plate 71 is recessed forward. The table plate 71 has a second extension surface 72 that extends horizontally, that is, in a direction perpendicular to the upper-lower direction. In a state where the wide table 7 is attached to the bed 10, the second extension surface 72 is on the same plane as the bed surface 110 or is several millimeters below the bed surface 110. Protrusions 87 and 88 protruding downward are disposed on a lower surface 710 of the table plate 71. The protrusion 87 is disposed at a right rear portion of the lower surface 710. The protrusion 88 is provided at a rear portion and a central portion in the left-right direction of the lower surface 710.

As shown in FIGS. 14A to 14C, the lever 84 is integrally formed with the lock release member 90. The lever 84 includes a protruding portion 841 that protrudes rightward from a rear end portion of a base plate 843 of the lock release member 90. The lever 84 protrudes rearward from a rear surface 73 of the table plate 71 at a position farther in the first direction N1 than the center of the longitudinal direction D2 of the table plate 71. The lever 84 includes a hook 85 that protrudes from a right rear portion of the protruding portion 841 in the first direction N1 at a position rearward of the rear surface 73 of the table plate 71. In the wide table 7, the lever 84 includes an inclined portion 86 located between the hook 85 and an end 83 of the lever 84 in the insertion direction J1, that is, the rear end of the lever 84. The inclined portion 86 is inclined in the longitudinal direction D2, more specifically, inclined leftward toward the rear. An elongated hole 842 extending in an arc shape in the left-right direction is formed in a right end portion of the protruding portion 841. The protrusion 87 is inserted into the elongated hole 842. The protrusion 74 protrudes rearward from the rear surface 73 of the table plate 71 at a position farther in the second direction N2 than the lever 84.

The lock release member 90 is connected to the lever 84, and is supported by the table plate 71 so as to be movable from the first position to the second position. The lock release member 90 includes the base plate 843, a support arm 846, and a protrusion 847. The base plate 843 have a hole 845 and an elongated hole 844 that are formed through the base plate 843 in the upper-lower direction. The hole 845 has a rectangular shape in a bottom view. The elongated hole 844 is formed in an arc shape at the left rear of the hole 845, and is inclined rightward toward the rear. The protrusion 88 is inserted into the elongated hole 844. The support arm 846 extends rightward from a right front portion of the base plate 843. A boss 712 extending downward in a cylindrical shape from the lower surface 710 of the table plate 71 is inserted into the right end of the support arm 846. The support arm 846 is attached to the table plate 71 by a screw 89 so as to be pivotable about the boss 712. That is, the lever 84 and the lock release member 90 are attached to the table plate 71 so as to be pivotable about the boss 712 while being guided by the elongated holes 842 and 844. The protrusion 847 extends leftward from the left end of the base plate 843.

As shown in FIG. 15, the spring 80 is disposed between the lower surface 710 of the table plate 71 and the protruding portion 841. The spring 80 urges the lock release member 90 in a direction from the second position toward the first position. The spring 80 is a coil spring. One end of the spring 80 is fixed to a flange 711 extending downward from the lower surface 710 of the table plate 71. The other end of the spring 80 is fixed to a protrusion 848 that protrudes upward from the upper surface of the protruding portion 841.

FIG. 14A is a bottom view of the wide table 7 when the lock release member 90 is at the first position, the lever 84 is at the normal position, and the legs 81 and 82 are at the storage position. FIG. 14B is a bottom view of the wide table 7 when the lock release member 90 is at the first position, the lever 84 is at the normal position, and the legs 81 and 82 are at the use position. FIG. 14C is a bottom view of the wide table 7 when the lock release member 90 is at the second position, the lever 84 is at the attachment-detachment position, and the legs 81 and 82 are at the use position. The leg 81 is coupled to a left portion of the lower surface 710 of the table plate 71 so as to be pivotable about a pivot shaft 811 extending horizontally between a use position at which the leg extends vertically and a storage position at which the leg extends horizontally. The leg 82 is connected to a right portion of the lower surface 710 of the table plate 71 so as to be pivotable about a pivot shaft 821 extending horizontally between a use position at which the leg extends vertically and a storage position at which the leg extends horizontally. As shown in FIG. 14A, when the leg 81 is at the storage position, the leg 81 and the protrusion 847 of the lock release member 90 contact each other, and the lock release member 90 is not movable from the first position to the second position. When the leg 82 is at the storage position, the leg 82 and the protruding portion 841 of the lever 84 contact each other, and the lock release member 90 is not movable from the first position to the second position.

When the wide table 7 is attached to the bed 10, the user inserts the lever 84 and the protrusion 74 of the wide table 7 into the opening 67 of the second mount portion 131 in a state where the legs 81 and 82 are moved from the storage position shown in FIG. 14A to the use position shown in FIG. 14B. When the wide table 7 is attached to the bed 10, the cover 69 of the second mount portion 131 is pushed in the insertion direction J1 by the lever 84, and thereby pivots from the closed position to the open position. The lever 84 is inserted into the opening 67 while the inclined portion 86 and the protrusion 74 contact the engagement edge 68, whereby the lever 84 pivots about the screw 89 from the normal position shown in FIG. 14B to the attachment-detachment position shown in FIG. 14C. After the hook 85 of the lever 84 is inserted into the opening 67 in the insertion direction J1, the lever 84 pivots from the attachment-detachment position to the normal position by the urging force of the spring 80, and the lock release member 90 pivots from the second position to the first position. This causes the hook 85 to engage with the second mount portion 131.

As shown in FIG. 1, in a state where the wide table 7 is attached to the bed 10, the end of the wide table 7 in the first direction N1 is located farther in the second direction N2 than the pillar 11 in the longitudinal direction D2. That is, the right end of the wide table 7 is located between the pillar 11 and the left end of the bed 10 in the longitudinal direction D2. In the longitudinal direction D2, the end of the wide table 7 in the second direction N2 is located farther in the second direction N2 than the first side plate 111. That is, the left end of the wide table 7 is located between the first side plate 111 and the first side plate 113 in the longitudinal direction D2. The wide table 7 is disposed forward of the bed 10, and is not disposed rearward of the bed 10. The rear surface 73 of the wide table 7 contacts the second side plate 121, and the second extension surface 72 forms a flat surface continuous with the bed surface 110. The lever 84 engages with the second mount portion 131 of the bed 10 above a center M2 of the wide table 7 in the upper-lower direction when the legs 81 and 82 are at the use position. Thus, a gap is less likely to be formed between the second extension surface 72 and the bed surface 110, compared with the case where the lever 84 engages with the second mount portion 131 of the bed 10 below the center of the wide table 7 in the upper-lower direction when the legs 81 and 82 are at the use position. The wide table 7 is disposed below a front right portion of the embroidery frame 150, and supports the front right portion of the embroidery frame 150 when the embroidery frame 150 is bent downward by the weight of the sewing workpiece.

When the wide table 7 is detached from the bed 10, the user places his or her finger on the hole 845 of the lock release member 90 of the wide table 7 and moves the lock release member 90 in the detachment direction J2, that is, forward. The lock release member 90 moves from the first position shown in FIG. 14B to the second position shown in FIG. 14C about the screw 89. The lever 84 pivots from the normal position shown in FIG. 14B to the attachment-detachment position shown in FIG. 14C, and release the engagement between the hook 85 and the second mount portion 131. The user moves the wide table 7 from the bed 10 in the detachment direction J2 and then releases the lock release member 90. The lever 84 pivots from the attachment-detachment position to the normal position by the urging force of the spring 80, and the lock releasing member 90 pivots from the second position to the first position. This configuration allows the user to store the wide table 7 in a compact manner in a state where the legs 81 and 82 are disposed at the storage position.

Figure 16A:
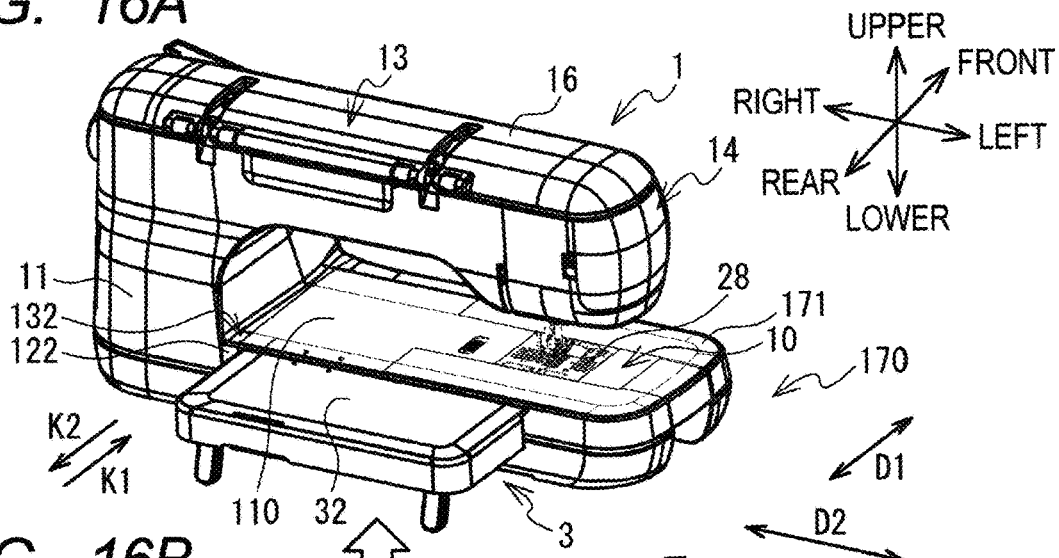
FIG. 16A is a perspective view of the sewing machine 1 to which the wide table 3 and an auxiliary device 170 are attached.
Figure 16B:
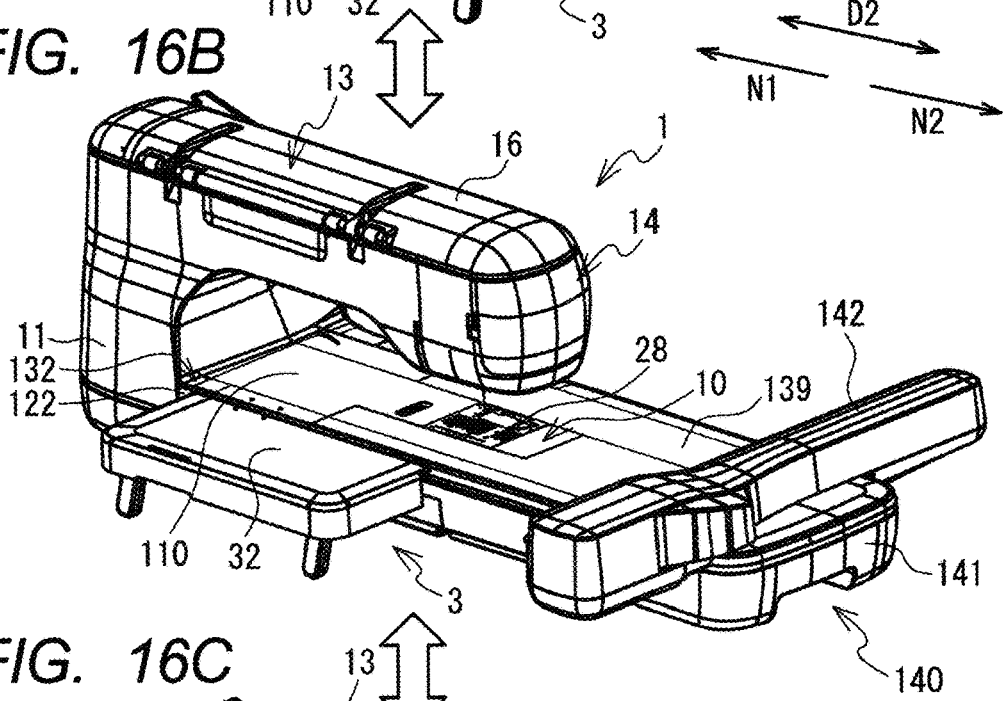
FIG. 16B is a perspective view of the sewing machine 1 to which the wide table 3 and the embroidery device 140 are attached.

Referring to FIGS. 16A to 18, auxiliary devices 170 and 200 configured to be detachably attached to the bed 10 of the sewing machine 1 will be described. As shown in FIGS. 16A, 16B, and 16C, a device selected from among the auxiliary device 170, the embroidery device 140, and the auxiliary device 200 is detachably attachable to the bed 10 of the sewing machine 1. The wide table 3 is detachably attachable to the bed 10 of the sewing machine 1 in each state where a device selected from among the auxiliary device 170, the embroidery device 140, and the auxiliary device 200 is attached. Although not shown in the drawings, the wide table 7 is detachably attachable to the bed 10 of the sewing machine 1 in a state where the auxiliary device 170 is attached.

Figure 17:
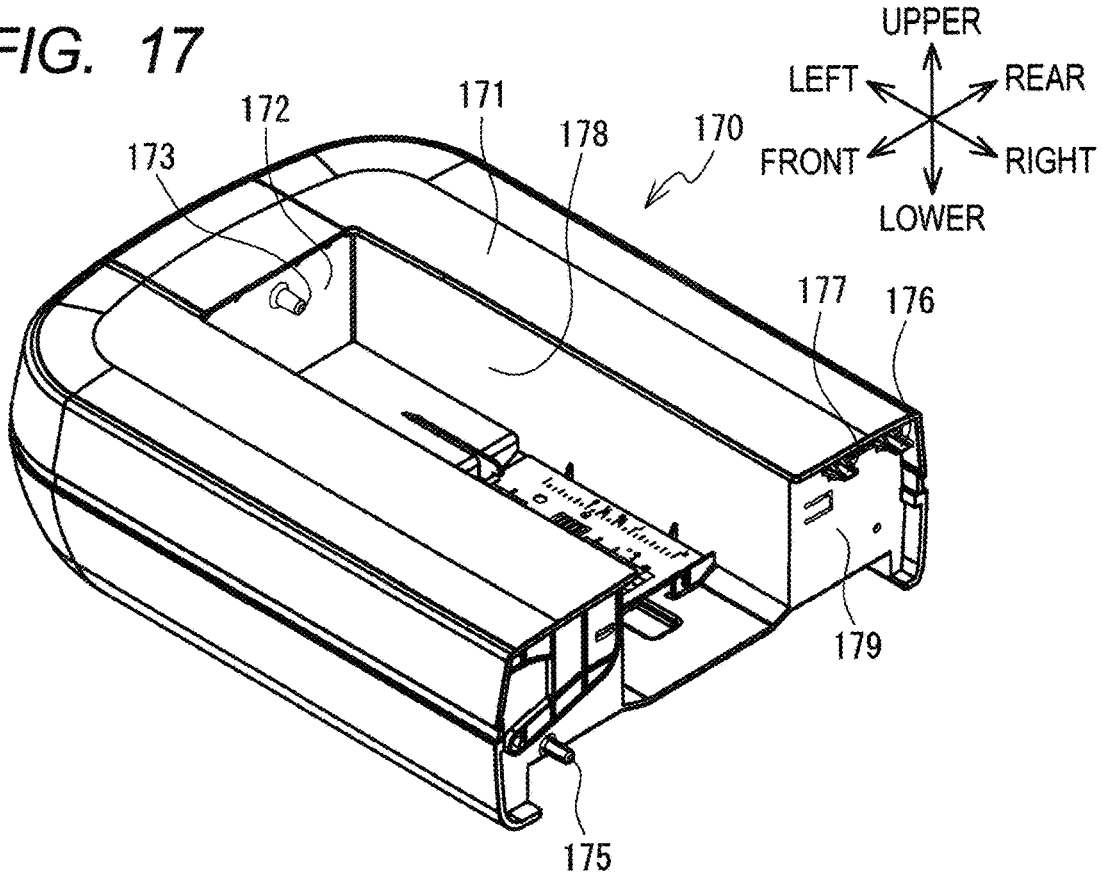
FIG. 17 is a perspective view of the auxiliary device 170.

As shown in FIGS. 16A and 17, the auxiliary device 170 is used by being attached to the bed 10 when the user performs a normal sewing operation that is not embroidery sewing. The auxiliary device 170 has a rectangular shape that is long in the left-right direction in a plan view. The length of the auxiliary device 170 in the left-right direction is longer than the length of the free arm 102 in the left-right direction. The auxiliary device 170 is formed with a recess 178 recessed leftward from a central portion in the front-rear direction of a right surface 179 of the auxiliary device 170. The auxiliary device 170 has a first extension surface 171 extending horizontally. The first extension surface 171 is an upper surface of the auxiliary device 170. The auxiliary device 170 is attached to the first mount portion 130. In a state where the auxiliary device 170 is attached to the first mount portion 130, the free arm 102 of the bed 10 is disposed in the recess 178. In a state where the auxiliary device 170 is attached to the first mount portion 130, the first extension surface 171 is on the same plane as the bed surface 110. Engagement claws 176 and 177 protrude rightward from the right surface 179 at positions rearward of the recess 178. An engagement protrusion 175 protrudes rightward from the right surface 179 in a cylindrical shape at a position forward of the recess 178. An engagement protrusion 173 protrudes rightward from a left surface 172 of the recess 178 in a cylindrical shape. In a state where the auxiliary device 170 is attached to the first mount portion 130, the engagement claws 176 and 177 are inserted into the engagement holes 119 and 120, respectively, and are detachably engaged with the first side plate 111 of the first mount portion 130. The engagement protrusion 173 is inserted into the engagement hole 161 and detachably engages with the first side plate 113 of the first mount portion 130. The engagement protrusion 175 is inserted into the engagement hole 155 and detachably engages with the first side plate 111 of the first mount portion 130.

Figure 16C:
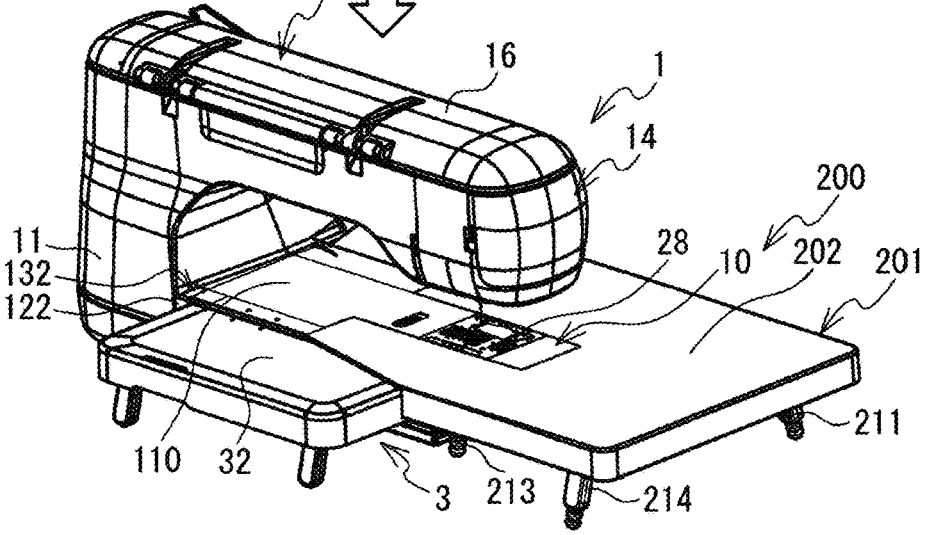
FIG. 16C is a perspective view of the sewing machine 1 to which the wide table 3 and an auxiliary device 200 are attached.
Figure 18:
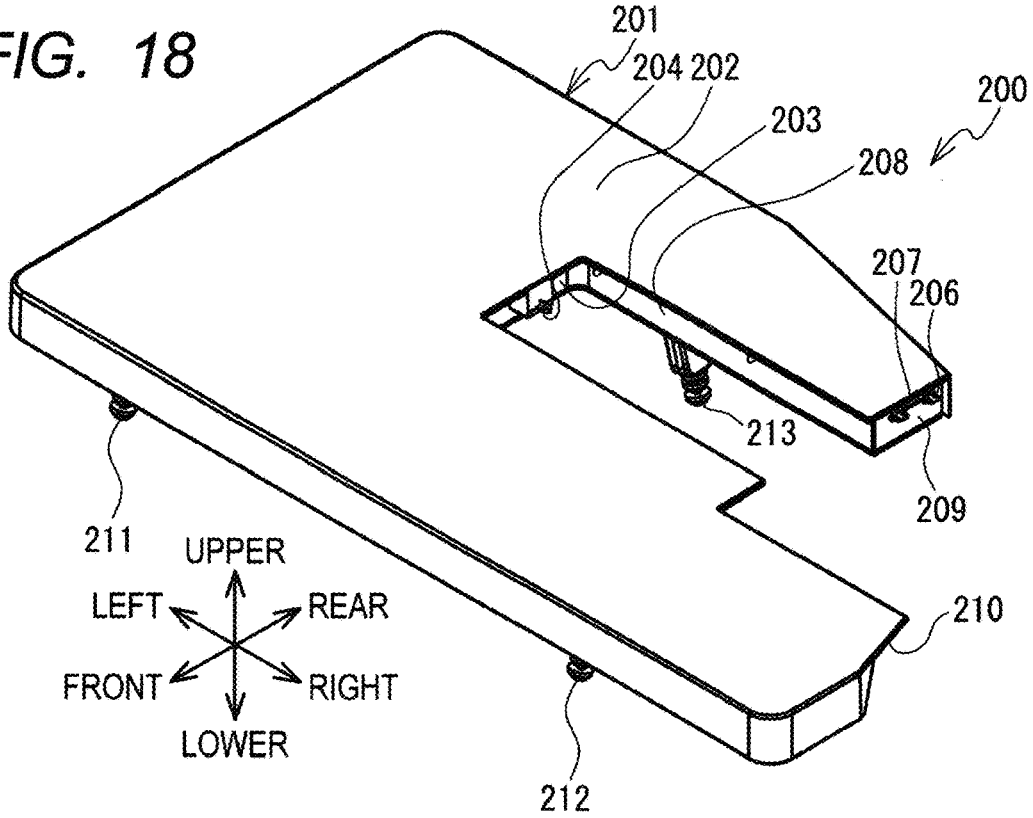
FIG. 18 is a perspective view of the auxiliary device 200.

As shown in FIGS. 16C and 18, the auxiliary device 200 is used by being attached to the bed 10 when the user performs a normal sewing operation that is not embroidery sewing. The length of the auxiliary device 200 in the left-right direction is longer than the length of the free arm 102 in the left-right direction. The auxiliary device 200 includes an extension plate 201 and legs 211, 212, 213 and 214. The extension plate 201 is a plate having a C-shape in a plan view. A recess 208 is formed to be recessed leftward from a center portion of a right surface 209 of the extension plate 201 in the front-rear direction. The extension plate 201 has a first extension surface 202 extending horizontally. The first extension surface 202 is an upper surface of the auxiliary device 200. The first extension surface 202 is larger than the first extension surface 171 of the auxiliary device 170. The auxiliary device 200 is attached to the first mount portion 130. In a state where the auxiliary device 200 is attached to the first mount portion 130, the free arm 102 of the bed 10 is disposed in the recess 208. In a state where the auxiliary device 200 is attached to the first mount portion 130, the first extension surface 202 is on the same plane as the bed surface 110.

Engagement claws 206 and 207 protrude rightward from the right surface 209 at positions rearward of the recess 208. An engagement protrusion 204 protrudes rightward from a left surface 203 of the recess 208. In a state where the auxiliary device 200 is attached to the first mount portion 130, the engagement claws 206 and 207 are inserted into the engagement holes 119 and 120, respectively, and detachably engage with the first side plate 111 of the first mount portion 130. The engagement protrusion 204 is inserted into the engagement hole 161 and detachably engages with the first side plate 113 of the first mount portion 130.

The legs 211 to 214 are coupled to a lower surface 210 of the extension plate 201. Each of the legs 211 to 214 is coupled to the extension plate 201 so as to be pivotable about a pivot shaft extending horizontally between a use position at which the leg extends vertically and a storage position at which the leg extends horizontally. The leg 211 is supported by a front left end portion of the extension plate 201. The leg 212 is supported by a front right end portion of the extension plate 201. The leg 213 is supported by a rear and left-right center portion of the extension plate 201. The leg 214 is supported by a rear left end portion of the extension plate 201.

An electrical configuration of the sewing machine 1 will be described with reference to FIG. 19. The controller 2 of the sewing machine 1 includes a CPU 75, a ROM 76, a RAM 77, a memory (storage) 78, and an input-output (I/O) interface 70. The CPU 75 is connected to the ROM 76, the RAM 77, the memory 78, and the input-output interface 70 via a bus 79.

The CPU 75 performs main control of the sewing machine 1, and executes various types of calculation and processing relating to sewing in accordance with various types of programs stored in the ROM 76. The ROM 76 includes a plurality of storage areas including a program storage area, which are not shown. The program storage area stores various programs for operating the sewing machine 1, including a program for executing a main process that will be described later.

The RAM 77 has a storage area for storing operation results of the operation processing performed by the CPU 75, for example. The memory 78 stores various parameters for the sewing machine 1 to execute various processing, for example. The memory 78 stores sewing data for sewing various sewing patterns that are sewable by the sewing machine 1, for each of a plurality of sewing patterns. The sewing data includes coordinate data. The coordinate data is data that indicates formation positions of stitches included in a sewing pattern, that is, the positions of needle points, by the coordinates of the embroidery coordinate system. That is, the coordinate data includes data representing a plurality of coordinates for each needle point. The memory 78 stores, as frame type information, correspondence between types of embroidery frames that are attachable to the holder 143 and sewing regions. The sewing region is a sewable region that is set inside the embroidery frame that is attached to the holder 143 of the sewing machine 1. The memory 78 stores, as a large frame, an embroidery frame having a size larger than or equal to a particular size.

The input-output interface 70 is connected to drive circuits 91, 92, 93 and 94, the touch screen 26, the start-stop switch 29, a frame sensor 22, and table sensors 20 and 24. The frame sensor 22 is configured to detect that an embroidery frame has been attached to the embroidery device 140, and to output a detection result corresponding to the type of the embroidery frame. The frame sensor 22 of the present example detects the type of the embroidery frame in accordance with a combination of ON and OFF of a plurality of mechanical switches. The table sensor 20 is configured to mechanically detect whether the wide table 7 is attached to the second mount portion 131 of the bed 10 and output a detection result. The table sensor 24 is configured to mechanically detect whether the wide table 3 is attached to the second mount portion 132 of the bed 10 and output a detection result.

The sewing machine motor 25 is connected to the drive circuit 91. The drive circuit 91 drives the sewing machine motor 25 in accordance with a control signal from the CPU 75. In accordance with the driving of the sewing machine motor 25, the needle bar 6 swings in the upper-lower direction via the main drive shaft. The drive circuit 92 drives the LCD 21 in accordance with a control signal from the CPU 75, thereby displaying an image on the LCD 21. The X motor 144 is connected to the drive circuit 93. The Y motor 145 is connected to the drive circuit 94. The drive circuits 93 and 94 drive the X motor 144 and the Y motor 145, respectively, in accordance with control signals from the CPU 75. In accordance with the driving of the X motor 144 and the Y motor 145, the embroidery frame 150 attached to the embroidery device 140 moves in the X direction and the Y direction by the movement amount corresponding to the control signal.

The operation of the sewing machine 1 will be briefly described. When embroidery sewing is performed using the embroidery frame 150, the needle bar 6 is swung in the upper-lower direction in conjunction with an operation in which the embroidery frame 150 is moved in the X direction and the Y direction by the embroidery device 140. In this way, a sewing pattern is sewn on the sewing workpiece held by the embroidery frame 150 by the sewing needle 4 attached to the needle bar 6.

The main process will be described with reference to FIG. 20. In response to acquiring a selection instruction to select a sewing pattern that is the target of embroidery sewing, the CPU 75 of the sewing machine 1 reads and executes a program to perform the main process. The selection instruction may be input to the sewing machine 1 from an external device, or may be input via the touch screen 26. The program includes an instruction to cause the CPU 75 to execute the following processing. Various data obtained in the main process are stored in the RAM 77 as appropriate. Hereinafter, a step is abbreviated as "S".

Figure 20:
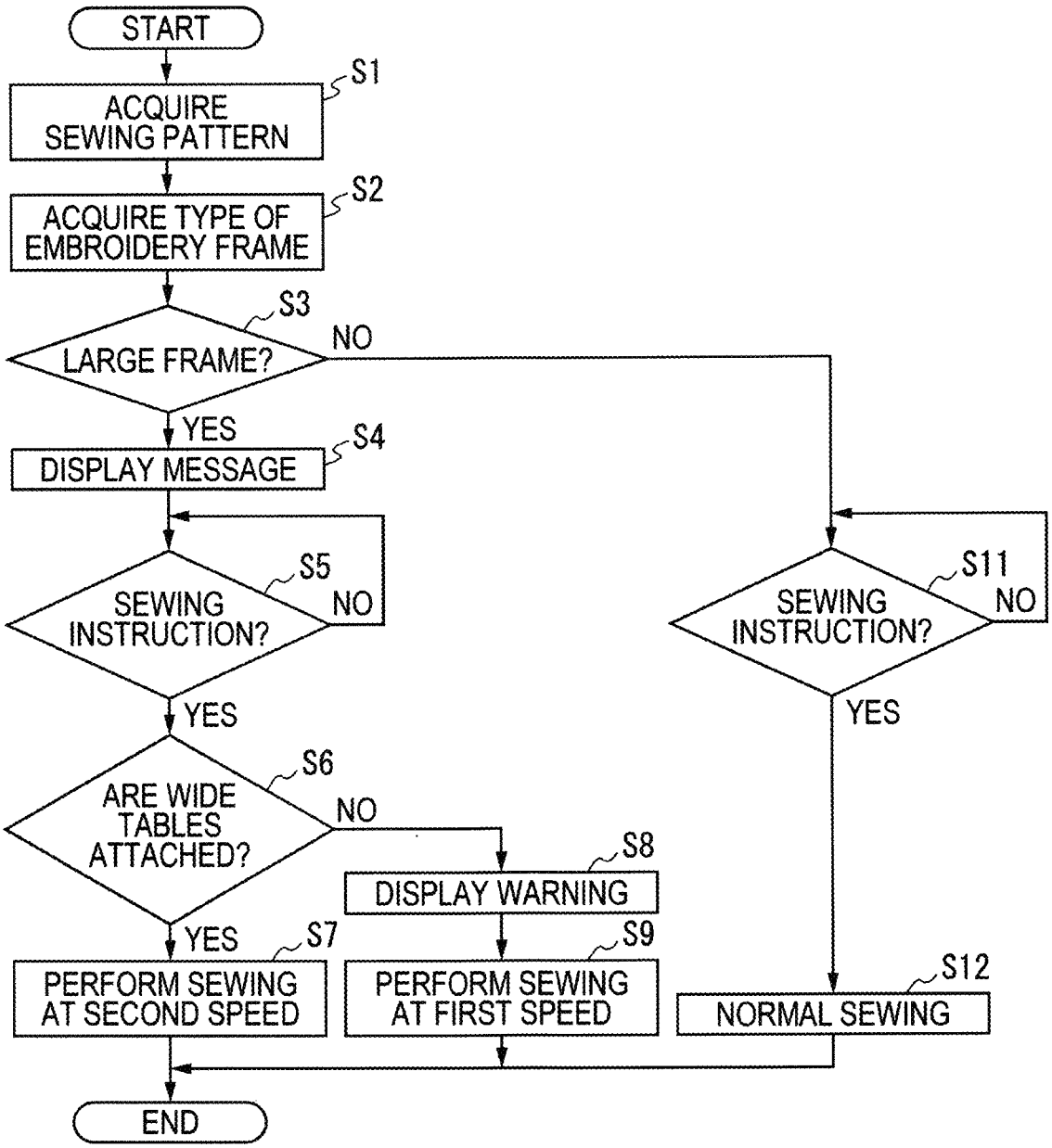
FIG. 20 is a flowchart of a main process.

As shown in FIG. 20, the CPU 75 acquires sewing data of the sewing pattern included in the selection instruction (S1). The CPU 75 acquires the type of the embroidery frame 150 attached to the holder 143 based on the detection result of the frame sensor 22 (S2). The CPU 75 determines whether the embroidery frame 150 attached to the holder 143 is a large frame based on whether the type of the embroidery frame 150 acquired in S2 is stored as a large frame in the memory 78 (S3). In response to determining that the embroidery frame attached to the holder 143 is not the large frame (S3: NO), the CPU 75 determines whether a sewing instruction has been detected (S11). In response to determining that the sewing instruction has not been detected (S11: NO), the CPU 75 returns the processing to S11. In response to determining that the sewing instruction has been detected (S11: YES), the CPU 75 performs normal embroidery sewing in accordance with the sewing data acquired in S1 (S12).

In the specific examples, it is determined that the embroidery frame 150 attached to the holder 143 is a large frame (S3: YES). Thus, the CPU 75 performs a notification process (S4) based on the detection result of the frame sensor 22. The notification process is a process of, in a case where the embroidery frame 150 of a particular size is attached, notifying that the wide table 7 is to be attached to the second mount portion 131 and the wide table 3 is to be attached to the second mount portion 132. Specifically, the CPU 75 controls the LCD 21 to display a message for prompting to attach the wide table 7 to the second mount portion 131 and to attach the wide table 3 to the second mount portion 132.

The CPU 75 determines whether a sewing instruction has been detected (S5). In response to determining that the sewing instruction has not been detected (S5: NO), the CPU 75 returns the processing to S5. In response to determining that the sewing instruction has been detected (S5: YES), the CPU 75 determines whether the wide table 7 is attached to the second mount portion 131 and the wide table 3 is attached to the second mount portion 132 based on the detection results of the table sensors 20 and 24 (S6). In response to determining that the wide table 7 is attached to the second mount portion 131 and the wide table 3 is attached to the second mount portion 132 (S6: YES), the CPU 75 drives the needle bar 6 in the upper-lower direction at a second speed that is faster than a first speed, and performs embroidery sewing in accordance with the sewing data acquired in S1 (S7).

In response to determining that the wide table is not attached to at least the second mount portion 131 or the second mount portion 132 (S6: NO), the CPU 75 performs a warning process of outputting a warning (S8). Specifically, the CPU 75 controls the LCD 21 to display a message to warn that sewing will be performed in a state where the wide table is not attached to at least the second mount portion 131 or the second mount portion 132. The CPU 75 drives the needle bar 6 in the upper-lower direction at the first speed in accordance with the sewing data acquired in S1, and performs embroidery sewing in accordance with the sewing data acquired in S1 (S9). After S7, S9 or S12, the CPU 75 ends the main process.

Figure 21:
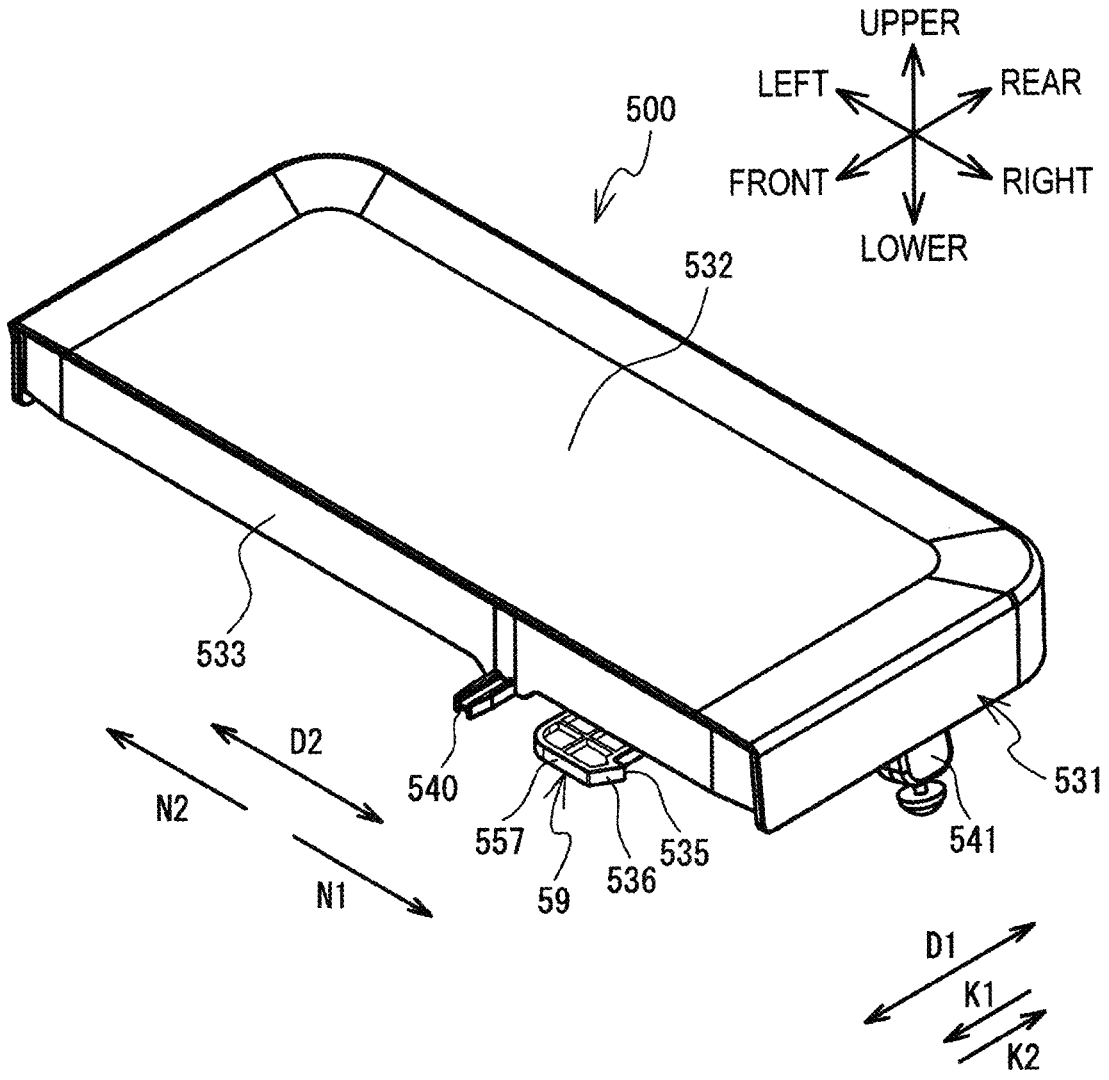
FIG. 21 is a perspective view of a wide table 500.
Figure 22A:
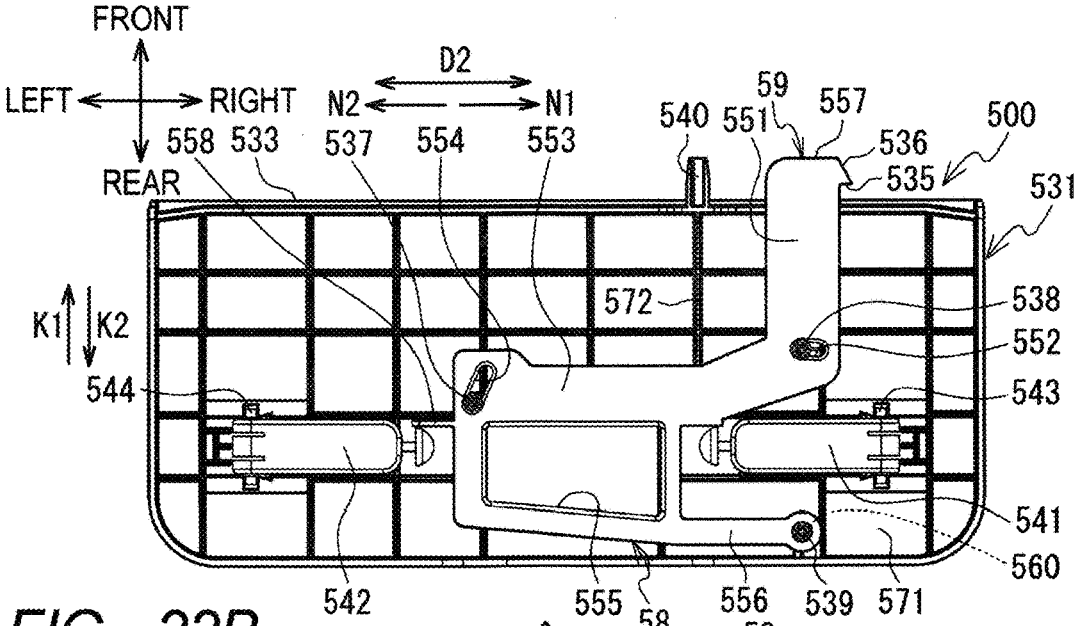
FIG. 22A is a bottom view of the wide table 500.
Figure 22B:
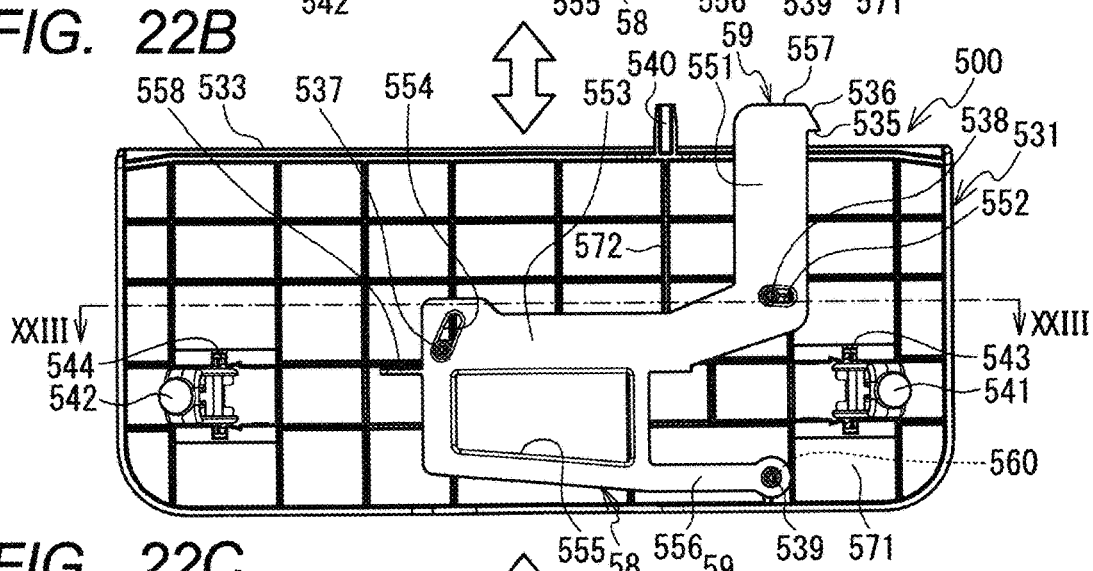
FIG. 22B is a bottom view of the wide table 500.
Figure 22C:
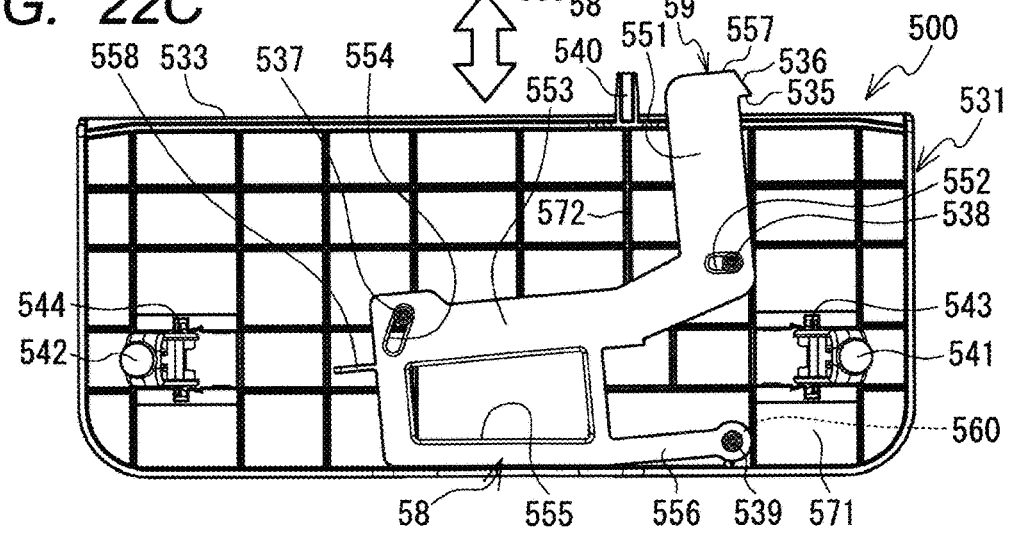
FIG. 22C is a bottom view of the wide table 500.
Figure 23:
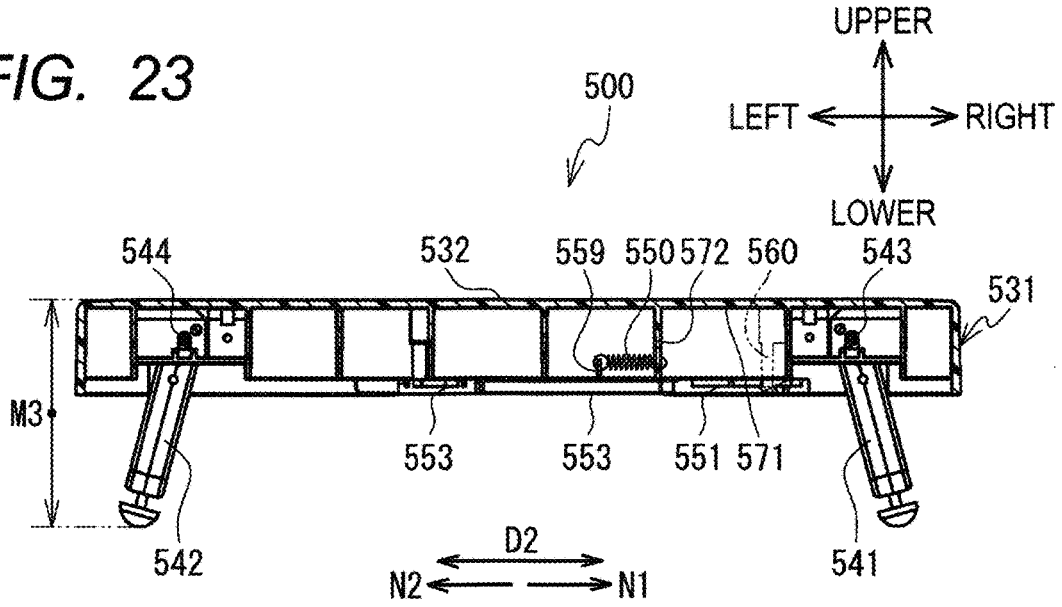
FIG. 23 is a cross-sectional view taken along a line XXIII-XXIII of FIG. 22B.

Referring to FIGS. 21 to 23, a wide table 500 of a first modification will be described. Although not shown, the wide table 500 is detachably attached to the second mount portion 132 of the bed 10. In a state where the wide table 500 is attached to the bed 10, the wide table 500 is disposed rearward of the bed 10. The wide table 500 includes a table plate 531, legs 541 and 542, a lever 59, a protrusion 540, a lock release member 58, and a spring 550.

The table plate 531 has a rectangular shape that is long in the left-right direction in a plan view. The table plate 531 has a second extension surface 532 that extends horizontally, that is, in a direction perpendicular to the upper-lower direction. In a state where the wide table 500 is attached to the bed 10, the second extension surface 532 is on the same plane as the bed surface 110 or is several millimeters below the bed surface 110. Protrusions 537 and 538 protruding downward are disposed on a lower surface 571 of the table plate 531. The protrusion 537 is disposed slightly leftward of the center of the lower surface 571. The protrusion 538 is disposed rightward of the center of the lower surface 571.

As shown in FIGS. 22A to 22C, the lever 59 is integrally formed with the lock release member 58. The lever 59 includes a protruding portion 551 that protrudes rightward from the front end of a base plate 553 of the lock release member 58. The lever 59 includes a hook 535 protruding in the first direction N1 at a front end portion protruding in the insertion direction K1 from a front surface 533 of the table plate 531. The lever 59 includes an inclined portion 536 located between the hook 535 and an end 557 of the lever 59 in the insertion direction K1. The inclined portion 536 is inclined in the second direction N2 toward the insertion direction K1. An elongated hole 552 extending in an arc shape in the left-right direction is formed in a right end portion of the lever 59. The protrusion 538 is inserted into the elongated hole 552. The protrusion 540 protrudes forward from the front surface 533 of the table plate 531 at a position farther in the second direction N2 than the lever 59.

The lock release member 58 is connected to the lever 59, and is supported by the table plate 531 so as to be movable from a first position to a second position. The lock release member 58 includes the base plate 553, a support arm 556, and a protrusion 558. A hole 555 and an elongated hole 554 are formed through the base plate 553 in the upper-lower direction. The hole 555 has a rectangular shape in a bottom view. The elongated hole 554 is formed in an arc shape at the left front of the hole 555 so as to be inclined rightward toward the front. The protrusion 537 is inserted into the elongated hole 554. The support arm 556 extends rightward from a right rear portion of the base plate 553. A boss 560 is inserted into the right end of the support arm 556, and the support arm 556 is fixed to the table plate 531 by a screw 539 so as to be pivotable about the boss 560. That is, the lever 59 and the lock release member 58 are fixed to the table plate 531 so as to be pivotable about the boss 560 while being guided by the elongated holes 552 and 554. The protrusion 558 extends leftward from the left end of the base plate 553.

The spring 550 is disposed between the table plate 531 and the base plate 553 in the upper-lower direction. The spring 550 urges the lock release member 58 in a direction from the second position toward the first position. The spring 550 is a coil spring. One end of the spring 550 is fixed to a flange 572 that extends downwardly from the lower surface 571 of the table plate 531. The other end of the spring 550 is fixed to a protrusion 559 which protrudes upward from the upper surface of the protrusion 558.

FIG. 22A is a bottom view of the wide table 500 when the lock release member 58 is at the first position, the lever 59 is at the normal position, and the legs 541 and 542 are at the storage position. FIG. 22B is a bottom view of the wide table 500 when the lock release member 58 is at the first position, the lever 59 is at the normal position, and the legs 541 and 542 are at the use position. FIG. 22C is a bottom view of the wide table 500 when the lock release member 58 is at the second position, the lever 59 is at the attachment-detachment position, and the legs 541 and 542 are at the use position. The leg 541 is coupled to a right portion of the lower surface 571 of the table plate 531 so as to be pivotable about a pivot shaft 543 extending horizontally between a use position at which the leg extends vertically and a storage position at which the leg extends horizontally. The leg 542 is connected to a left portion of the lower surface 571 of the table plate 531 so as to be pivotable about a pivot shaft 544 extending horizontally between a use position at which the leg extends vertically and a storage position at which the leg extends horizontally. As shown in FIG. 22A, in a state where the leg 541 is at the storage position, the leg 541 and the lever 59 contact each other, and the lock release member 58 is not movable from the first position to the second position. In a state where the leg 542 is at the storage position, the leg 542 and the protrusion 558 contact each other, and the lock release member 58 is not movable from the first position to the second position.

When the wide table 500 is attached to the bed 10, the user inserts the lever 59 and the protrusion 540 of the wide table 500 into the opening 65 in a state where the legs 541 and 542 are moved from the storage position shown in FIG. 22A to the use position shown in FIG. 22B. When the wide table 500 is attached to the bed 10, the cover 62 of the second mount portion 132 is pushed in the insertion direction K1 by the lever 59, and thereby pivots from the closed position to the open position. The lever 59 is inserted into the opening 65 while the inclined portion 536 and the protrusion 540 contact the engagement edge 66, whereby the lever 59 pivots from the normal position shown in FIG. 22B to the attachment-detachment position shown in FIG. 22C. After the hook 535 of the lever 59 is inserted into the opening 65 in the insertion direction K1, the lever 59 pivots about the boss 560 from the attachment-detachment position to the normal position by the urging force of the spring 550. This causes the hook 535 to engage with the second mount portion 132. In a state where the legs 541 and 542 are at the use position, the table plate 531 and the lever 59 are located above a center M3 of the wide table 500 in the upper-lower direction.

When the wide table 500 is detached from the bed 10, the user places a finger on the hole 555 of the lock release member 58 of the wide table 500 and moves the lock release member 58 rearward. The lock release member 58 moves from the first position shown in FIG. 22B to the second position shown in FIG. 22C about the boss 560. The lever 59 pivots from the normal position shown in FIG. 22B to the attachment-detachment position shown in FIG. 22C, and the engagement between the hook 535 and the second mount portion 132 is released. The user moves the wide table 500 from the bed 10 in the detachment direction K2 and then releases the lock release member 58. The lever 59 pivots from the attachment-detachment position to the normal position by the urging force of the spring 550. This configuration allows the user to store the wide table 500 in a compact manner in a state where the legs 541 and 542 are arranged at the storage position.

Figure 24:
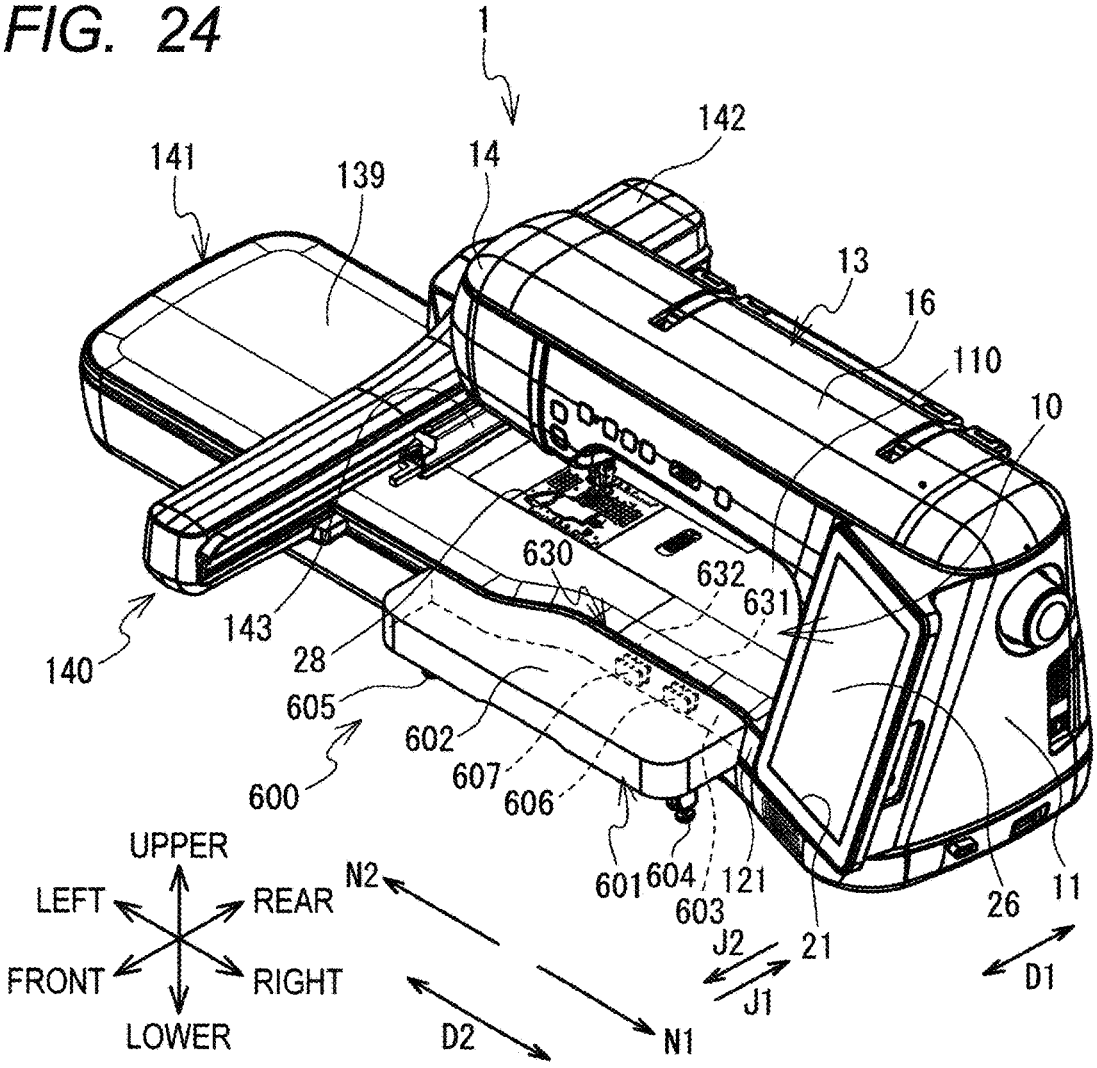
FIG. 24 is a perspective view of the sewing machine 1 to which a wide table 600 is attached.

Referring to FIG. 24, a wide table 600 of a second modification will be described. As shown in FIG. 24, the wide table 600 is detachably attached to the second mount portion 131 of the bed 10. In a state where the wide table 600 is attached to the bed 10, the wide table 600 is located forward of the bed 10. The wide table 600 includes a table plate 601, legs 604 and 605, and second magnets 606 and 607.

The table plate 601 has a rectangular shape that is long in the left-right direction in a plan view. The left rear portion of the table plate 601 is recessed forward. The table plate 601 has a second extension surface 602 that extends horizontally, that is, in a direction perpendicular to the upper-lower direction. In a state where the wide table 600 is attached to the bed 10, the second extension surface 602 is on the same plane as the bed surface 110 or is several millimeters below the bed surface 110. The second magnets 606 and 607 are fixed to a rear surface 603 of the table plate 601. The second magnets 606 and 607 are arranged in the left-right direction. The second magnet 606 has the same magnetic field direction as a first magnet 631. The second magnet 607 has the same magnetic field direction as a first magnet 632. The directions of the magnetic field of the second magnet 606 and the second magnet 607 are different. The directions of the magnetic fields of the first magnet 631 and the first magnet 632 are different. For example, in a case where the rear surface of the second magnet 606 is the S pole, the first magnet 631 is disposed at the sewing machine 1 such that the front surface of the first magnet 631 is the N pole. In this case, the first magnet 632 is disposed at the sewing machine 1 such that the rear surface of the second magnet 607 is the N pole and the front surface of the first magnet 632 is the S pole. In this way, the second magnets 606 and 607 disposed adjacent to each other are disposed so as to generate magnetic fields different from each other. The first magnets 631 and 632 disposed adjacent to each other are disposed so as to generate magnetic fields different from each other. That is, the first magnet 631 and the second magnet 606 attract each other by magnetic force, and the first magnet 632 and the second magnet 607 attract each other by magnetic force. In contrast, the first magnet 631 and the second magnet 607 repel each other with a repulsive force, and the first magnet 632 and the second magnet 606 repel each other with a repulsive force. Thus, the second magnets 606 and 607 contribute to the wide table 600 being attached to an appropriate position on the bed 10.

The leg 604 is coupled to a right portion of the lower surface of the table plate 601 so as to be pivotable about a pivot shaft extending horizontally between a use position at which the leg 604 extends vertically and a storage position at which the leg 604 extends horizontally. The leg 605 is connected to a left portion of the lower surface of the table plate 601 so as to be pivotable about a pivot shaft extending horizontally between a use position at which the leg 605 extends vertically and a storage position at which the leg 605 extends horizontally.

When the wide table 600 is attached to the bed 10, the user brings the second magnets 606 and 607 of the wide table 600 into contact with the first magnets 631 and 632 provided on the second side plate 121 of the sewing machine 1 in a state where the legs 604 and 605 have been moved to the use position shown in FIG. 24. The wide table 600 is attached to the bed 10 by the magnetic force between the first magnets 631 and 632 and the second magnets 606 and 607. When the wide table 600 is detached from the bed 10, the user moves the wide table 600 from the bed 10 in the detachment direction J2 against the magnetic force between the first magnets 631 and 632 and the second magnets 606 and 607. This configuration allows the user to store the wide table 7 in a compact manner in a state where the legs 604 and 605 are disposed at the storage position.

In the above embodiment, the sewing machine 1, the needle bar 6, the bed 10, the pillar 11, the outer periphery 19, and the bed surface 110 are examples of a sewing machine, a needle bar, a pillar, an outer periphery, and a bed surface of the present disclosure. The wide tables 3, 7, 500, and 600 are examples of a wide table of the present disclosure. The table sensors 20 and 24 are examples of a table sensor of the present disclosure. The frame sensor 22 is an example of a frame sensor of the present disclosure. The springs 30, 80, and 550 are examples of a spring of the present disclosure. The table plates 31, 71, 531, and 601 are examples of a table plate of the present disclosure. The first lever 35, the second lever 34, and the levers 59 and 84 are examples of a lever of the present disclosure. The second extension surfaces 32, 72, 532, and 602 are examples of a second extension surface of the present disclosure. The first lever 35 and the second lever 34 are examples of a first lever and a second lever of the present disclosure, respectively. The first hook 37 and the second hook 36 are examples of a first hook and a second hook of the present disclosure, respectively. The first inclined portion 39, the second inclined portion 38, and the inclined portions 86 and 536 are examples of an inclined portion of the present disclosure. The lock release members 45, 58, and 90 are examples of a lock release member of the present disclosure. The covers 62 and 69 are examples of a cover of the present disclosure. The openings 65 and 67 are examples of an opening of the present disclosure. The engagement edges 66 and 68 are examples of an engagement edge of the present disclosure. The CPU 75 is an example of a processor (controller) of the present disclosure. The legs 41 to 43, 81, 82, 541, 542, 604, and 605 are examples of a leg of the present disclosure. The ends 83, 340, 350, and 557 are examples of an end of the present disclosure. The hooks 85 and 535, the first hook 37, and the second hook 36 are examples of a hook of the present disclosure. The first side plates 111 and 113 are examples of a first side plate of the present disclosure. The second side plates 121 and 122 are examples of a second side plate of the present disclosure. The first mount portion 130 is an example of a first mount portion of the present disclosure. The second mount portions 131, 132, and 630 are examples of a second mount portion of the present disclosure. The embroidery device 140 and the auxiliary devices 170 and 200 are examples of an auxiliary device of the present disclosure. The embroidery device 140, the holder 143, and the embroidery frame 150 are examples of an embroidery device, a holder, and an embroidery frame of the present disclosure, respectively. The first detachment end portion 352, the second detachment end portion 342, the second protrusion 461, and the first protrusion 462 are examples of a first detachment end portion, a second detachment end portion, a second protrusion, and a first protrusion, respectively, of the present disclosure. The second magnets 606 and 607 are examples of a second magnet of the present disclosure. The first magnets 631 and 632 are examples of a first magnet of the present disclosure. The pivot shafts 811 and 821 are examples of a pivot shaft of the present disclosure. The short direction D1, the longitudinal direction D2, the first direction N1, and the second direction N2 are examples of a short direction, a longitudinal direction, a first direction, and a second direction, respectively, of the present disclosure. The insertion directions J1 and K1 are examples of an insertion direction of the present disclosure. The detachment directions J2 and K2 are examples of a detachment direction of the present disclosure.

The sewing machine 1 of the above-described embodiment includes the bed 10. The bed 10 includes the bed surface 110, the first side plates 111 and 113, the second side plate 122, the first mount portion 130, and the second mount portion 132. The bed surface 110 extends horizontally, that is, in a direction perpendicular to the upper-lower direction. The first side plates 111 and 113 extend downward from the outer periphery 19 of the bed surface 110 and cross the longitudinal direction D2 of the bed surface 110. The second side plate 122 extends downward from the outer periphery 19 of the bed surface 110 and crosses the short direction D1 of the bed surface 110. The first mount portion 130 is configured that an auxiliary device having a first extension surface extending horizontally is attachable, and is provided at the first side plates 111 and 113. The second mount portion 132 is configured that the wide table 3 having the second extension surface 32 extending horizontally and having a shape different from that of the auxiliary device is attachable. The second mount portion 132 is provided at the second side plate 122. The sewing machine 1 is configured that the auxiliary device is attachable to the first mount portion 130 and the wide table 3 is attachable to the second mount portion 132. That is, the wide table 3 is attachable in a state where the auxiliary device is attached to the bed 10, and the bed surface 110 is extended by the second extension surface 32. Thus, the second mount portion 132 of the sewing machine 1 contributes to extending the surface on which the user places a sewing workpiece when sewing the sewing workpiece that is larger than the bed surface 110 and improving the convenience when sewing the sewing workpiece that is larger than the bed surface 110. The second mount portions 131 and 630 of the sewing machine 1 also contribute to achieving a similar effect to the second mount portion 132.

The wide table 3 is detachably attached to the second mount portion 132 of the bed 10. The wide table 3 includes the table plate 31 having the second extension surface 32. In a case where a large sewing workpiece is sewn, the sewing machine 1 supports the sewing workpiece by the bed 10 and the wide table 3 by attaching the wide table 3 to the bed 10, and thus the wide table 3 contributes to improving convenience during sewing. The wide tables 7, 500, and 600 also contribute to achieving a similar effect to the wide table 3.

The second mount portion 132 includes the engagement edge 66 that defines the opening 65 formed in the second side plate 122. When one direction along the short direction D1 is defined as the insertion direction K1, the wide table 3 includes the levers 34 and 35 that protrude from the table plate 31 in the insertion direction K1 and that are supported by the table plate 31. The levers 34 and 35 are inserted into the opening 65 in the insertion direction K1, and the levers 34 and 35 engage with the second mount portion 132, whereby the wide table 3 is attached to the bed 10. Compared with a configuration in which the levers 34 and 35 are provided at the bed 10 of the sewing machine 1 and the opening 65 is provided at the wide table 3, the engagement edge 66 of the sewing machine 1 contributes to the levers 34 and 35 not protruding from the bed 10 and not hindering sewing when the wide table 3 is not attached to the sewing machine 1. The engagement edge 68 of the sewing machine 1 also contributes to achieving a similar effect to the engagement edge 66 of the sewing machine 1.

The pillar 11 extends in the upper-lower direction and is connected to the bed 10. The second mount portion 132 is located between the first mount portion 130 and the pillar 11 in the longitudinal direction D2. The sewing machine 1 contributes to attaching the wide table 3 without interfering with the auxiliary device such as the embroidery device 140.

The second mount portions 131 and 630 of the sewing machine 1 also contribute to achieving a similar effect to the second mount portion 132.

The bed 10 includes the cover 62 that closes the opening 65 in a state where the wide table 3 is not attached to the bed 10. The cover 62 of the sewing machine 1 contributes to reducing dust entering the inside of the bed 10 through the opening 65, for example. The cover 69 of the second mount portion 131 also contributes to achieving a similar effect to the cover 62 of the second mount portion 132.

The cover 62 of the second mount portion 132 is supported by the bed 10 so as to be pivotable between the closed position at which the cover 62 closes the opening 65 and the open position at which the cover 62 opens the opening 65. When the wide table 3 is attached to the bed 10, the cover 62 is pushed in the insertion direction K1 by the levers 34 and 35, and thereby pivots from the closed position to the open position. The cover 62 of the sewing machine 1 contributes to preventing the cover 62 from being lost, compared with a case where the cover 62 is detachable. The cover 62 of the sewing machine 1 contributes to switching the cover 62 between the closed position and the open position by a simple operation of pivoting the cover 62 between the closed position and the open position by inserting the levers 34 and 35. The cover 69 of the second mount portion 131 also contributes to achieving a similar effect to the cover 62 of the second mount portion 132.

In the wide table 7, the lever 84 includes the hook 85 that protrudes in the first direction N1. When one direction along the longitudinal direction D2 is the first direction N1 and the opposite direction is the second direction N2, the lever 84 is supported by the table plate 71 so as to be pivotable between the normal position and the attachment-detachment position where the hook 85 is located farther in the second direction N2 than at the normal position. After the lever 84 is inserted into the opening 67 in the insertion direction J1, the lever 84 pivots from the attachment-detachment position to the normal position, whereby the hook 85 engages with the second mount portion 131. The lever 84 of the sewing machine 1 contributes to performing the operation of engaging the lever 84 with the second mount portion 131 by a relatively simple operation of pivoting the lever 84 from the attachment-detachment position to the normal position. The lever 59 including the hook 535 of the sewing machine 1 also contributes to achieving a similar effect to the lever 84 of the sewing machine 1.

In the wide table 7, the lever 84 includes the inclined portion 86 located between the hook 85 and the end 83 of the lever 84 in the insertion direction J1. The inclined portion 86 is inclined in the longitudinal direction D2. The lever 84 is inserted into the opening 67 while the inclined portion 86 contacts the engagement edge 68, whereby pivots from the normal position to the attachment-detachment position. After the hook 85 of the lever 84 is inserted into the opening 67 in the insertion direction J1, the lever 84 pivots from the attachment-detachment position to the normal position, and thereby the hook 85 engages with the second mount portion 131. The inclined portion 86 of the sewing machine 1 contributes to performing the operation of pivoting the lever 84 from the normal position to the attachment-detachment position by a relatively simple operation of inserting the inclined portion 86 into the opening 67 while the inclined portion 86 contacts the engagement edge 68. The inclined portion 536, the first inclined portion 39, and the second inclined portion 38 of the sewing machine 1 also contribute to achieving a similar effect to the inclined portion 86 of the sewing machine 1.

The wide table 7 of the sewing machine 1 includes the lock release member 90. The lock release member 90 is connected to the lever 84, and is supported by the table plate 71 so as to be movable from the first position to the second position. When the lock release member 90 is moved from the first position to the second position in a state where the wide table 7 is attached to the bed 10, the lever 84 pivots from the normal position to the attachment-detachment position, and the engagement between the hook 85 and the second mount portion 131 is released. The lock release member 90 of the wide table 7 of the sewing machine 1 contributes to performing the operation of pivoting the lever 84 from the normal position to the attachment-detachment position by a relatively simple operation of moving the lock release member 90 from the first position to the second position. The lock release members 45 and 58 of the sewing machine 1 also contribute to achieving a similar effect to the lock release member 90.

The wide table 7 of the sewing machine 1 includes the spring 80 that urges the lock release member 90 in the direction from the second position toward the first position. The spring 80 of the sewing machine 1 contributes to moving the lock release member 90 from the second position to the first position by the urging force of the spring 80 after the operation of moving the lock release member 90 from the first position to the second position. The springs 30 and 550 of the sewing machine 1 also contribute to a similar effect.

The second mount portion 132 includes the engagement edge 66 that defines the opening 65 formed in the second side plate 122. One direction along the short direction D1 is defined as the insertion direction K1. One direction along the longitudinal direction D2 is defined as the first direction N1, and the opposite direction is defined as the second direction N2. The wide table 3 of the sewing machine 1 includes the second lever 34 and the first lever 35 that protrude from the table plate 31 in the insertion direction K1. The second lever 34 includes the second hook 36 that protrudes in the second direction N2. The second lever 34 is supported by the table plate 31 so as to be pivotable between the second normal position and the second attachment-detachment position where the second hook 36 is located farther in the first direction N1 than the second normal position. After the second lever 34 is inserted into the opening 65, the second lever 34 pivots from the second attachment-detachment position to the second normal position, whereby the second hook 36 engages with the second mount portion 132. The first lever 35 includes the first hook 37 that protrudes in the first direction N1. The first lever 35 is supported by the table plate 31 so as to be pivotable between the first normal position and the first attachment-detachment position where the first hook 37 is located farther in the second direction N2 than the first normal position. After the first lever 35 is inserted into the opening 65, the first lever 35 pivots from the first attachment-detachment position to the first normal position, whereby the first hook 37 engages with the second mount portion 132. The second lever 34 and the first lever 35 of the sewing machine 1 contribute to reliably attaching the wide table 3 to the second mount portion 132 of the bed 10, compared with a case where one lever engages with the second mount portion 132.

The opposite direction along the short direction D1 of the wide table 3 is referred to as the detachment direction K2. The wide table 3 has the second protrusion 461 and the first protrusion 462. When the second lever 34 is at the second normal position and the wide table 3 is moved in the second direction N2 with respect to the bed 10, the second protrusion 461 contacts the second detachment end portion 342 of the second lever 34 in the detachment direction K2. The second protrusion 461 is located farther in the second direction N2 than the second detachment end portion 342. When the first lever 35 is located at the first normal position and the wide table 3 is moved in the first direction N1 with respect to the bed 10, the first protrusion 462 contacts the first detachment end portion 352 of the first lever 35 in the detachment direction K2. The first protrusion 462 is located farther in the first direction N1 than the first detachment end portion 352. The second protrusion 461 of the sewing machine 1 contributes to preventing the second lever 34 from pivoting from the second normal position toward the second attachment-detachment position. The first protrusion 462 contributes to preventing the first lever 35 from pivoting from the first normal position toward the first attachment-detachment position.

The wide table 7 includes the legs 81 and 82. The leg 81 is connected to the table plate 71 so as to be pivotable about the pivot shaft 811 extending horizontally between the use position at which the leg 81 extends vertically and the storage position at which the leg 81 extends horizontally. The leg 82 is connected to the table plate 71 so as to be pivotable about the pivot shaft 821 extending horizontally between the use position at which the leg 82 extends vertically and the storage position at which the leg 82 extends horizontally. In a state where the legs 81 and 82 are at the storage position, the legs 81 and 82 contact the lever 84 or the lock release member 90, and the lock release member 90 is not movable from the first position to the second position. The legs 81 and 82 of the sewing machine 1 contribute to preventing the wide table 7 from being attached to the second mount portion 131 of the bed 10 in a state where the legs 81 and 82 are at the storage position. The wide table 500 of the first modification also achieves a similar effect. The legs 541 and 542 of the wide table 500 also contribute to a similar effect to the legs 81 and 82 of the wide table 7.

The sewing machine 1 includes the table sensor 20 that detects whether the wide table 7 is attached to the second mount portion 131, the table sensor 24 that detects whether the wide table 3 is attached to the second mount portion 132, the needle bar 6, and the CPU 75. In response to determining that the wide table 7 is attached to the second mount portion 131 and the wide table 3 is attached to the second mount portion 132 based on the detection results of the table sensors 20 and 24 (S6: YES), the CPU 75 drives the needle bar 6 in the upper-lower direction at the second speed that is faster than the first speed which is used when at least one wide table is not attached to the second mount portions 131 and 132 (S7 and S9). The CPU 75 of the sewing machine 1 contributes to, when the wide tables 3 and 7 are attached, automatically switching the sewing speed considering that the sewing workpiece is stably supported, compared with a case where at least the wide table 3 or 7 is not attached.

The sewing machine 1 includes the table sensors 20 and 24, the embroidery device 140, the frame sensor 22, the needle bar 6, and the CPU 75. The table sensor 20 detects whether the wide table 7 is attached to the second mount portion 131. The table sensor 24 detects whether the wide table 3 is attached to the second mount portion 132. The embroidery device 140 is an auxiliary device that is attached to the first mount portion 130 of the bed 10. The embroidery device 140 includes the holder 143 to which the embroidery frame 150 is attachable, the holder 143 being movable horizontally. The frame sensor 22 detects the type of the embroidery frame attached to the holder 143. In a state where the wide table 3 is attached to the second mount portion 132, the second extension surfaces 32 and 72, the bed surface 110, and the first extension surface 139 are located below the embroidery frame 150. The CPU 75 acquires the detection result of the frame sensor 22 and, when the embroidery frame 150 of the particular size is attached (S3: YES), performs the notification process of notifying that the wide table 7 is to be attached the second mount portion 131 and the wide table 3 is to be attached to the second mount portion 132 (S4). When it is determined that the embroidery frame 150 of the particular size is attached based on the detection result of the frame sensor 22 and that the corresponding wide tables 7 and 3 are not attached to the second mount portions 131 and 132 based on the detection results of the table sensors 20 and 24 (S6: NO), the CPU 75 performs the warning process of outputting a warning (S8). The CPU 75 of the sewing machine 1 contributes to increasing the possibility that sewing is performed under a condition that the wide tables 3 and 7 support the embroidery frame 150 when the embroidery frame 150 is bent by the weight of the sewing workpiece in a case where the embroidery frame 150 that is relatively large is attached to the holder 143.

The embroidery device 140 is an auxiliary device that is attached to the first mount portion 130 of the bed 10. The embroidery device 140 includes the holder 143 to which the embroidery frame 150 is attachable, the holder 143 being movable horizontally. In a state where the wide table 3 is attached to the second mount portion 132, the second extension surface 32, the bed surface 110, and the first extension surface 139 are located below the embroidery frame 150. When the embroidery device 140 is attached to the sewing machine 1 and a sewing workpiece larger than the bed surface 110 is sewn, the wide table 3 of the sewing machine 1 supports the embroidery frame that holds the sewing workpiece together with the bed 10, and thus contributes to improving the ease of sewing by the sewing machine 1.

The second mount portion 630 of the sewing machine 1 of the second modification includes the first magnets 631 and 632. The table plate 601 of the wide table 600 includes the second magnets 606 and 607, and the wide table 600 is attached to the bed 10 by magnetic force between the first magnets 631 and 632 and the second magnets 606 and 607. The second mount portion 630 of the sewing machine 1 contributes to simplifying the configuration and operation for attaching the wide table 600.

The wide table 7 that is attached to the sewing machine 1 includes the table plate 71, the legs 81 and 82, the lever 84, the hook 85, and the lock release member 90. The table plate 71 has the second extension surface 72 which is a table surface extending horizontally. The legs 81 and 82 are connected to the table plate 71. The lever 84 protrudes from the table plate 71 in the insertion direction J1 which is one direction along the short direction D1 of the bed surface 110 of the sewing machine 1 that extends horizontally. When one direction along the longitudinal direction D2 of the bed surface 110 is defined as the first direction N1 and the opposite direction is defined as the second direction N2, the hook 85 protrudes in the first direction N1. The lever 84 is supported by the table plate 71 so as to be pivotable between the normal position and the attachment-detachment position where the hook 85 is located farther in the second direction N2 than the normal position. The opening 67 is formed in the second side plate 121 that extends downward from the outer periphery 19 of the bed surface 110 and that crosses the short direction D1. The lever 84 is inserted into the opening 67 in the insertion direction J1 and then pivots from the attachment-detachment position to the normal position, whereby the hook 85 engages with the second mount portion 131 of the sewing machine 1 that includes the engagement edge 68 that defines the opening 67. The lock release member 90 is connected to the lever 84, and is supported by the table plate 71 so as to be pivotable from the first position to the second position. When the lock release member 90 is moved from the first position to the second position, the lock release member 90 causes the lever 84 to pivot from the normal position to the attachment-detachment position, and releases the engagement between the hook 85 and the second mount portion 131 of the sewing machine 1. In a case where a sewing workpiece that is larger than the bed surface 110 is sewn, by attaching the wide table 7 to the bed 10, the wide table 7 of the sewing machine 1 supports the sewing workpiece together with the bed 10, and thus the wide table 7 contributes to improving the ease of sewing by the sewing machine 1. Since the wide table 7 of the sewing machine 1 is detachably attached to the bed 10, it is switchable whether to use the wide table 7 depending on the size of the sewing workpiece. Thus, the wide table 7 of the sewing machine 1 achieves both the compactness of the sewing machine 1 and the improvement in the ease of sewing a relatively large sewing workpiece, as compared with a case where the wide table 7 is not detachable from the bed 10. The lever 84 of the sewing machine 1 contributes to performing the operation of engaging the lever 84 and the second mount portion 131 by a relatively simple operation of pivoting the lever 84 from the attachment-detachment position to the normal position. The lock release member 90 of the sewing machine 1 contributes to performing the operation of pivoting the lever 84 from the normal position to the attachment-detachment position by a relatively simple operation of moving the lock release member 90 from the first position to the second position. The wide tables 3 and 500 also contribute to a similar effect.

While the disclosure has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the disclosure, and not limiting the disclosure. Various changes may be made without departing from the spirit and scope of the disclosure. Thus, the disclosure is intended to embrace all known or later developed alternatives, modifications, variations, improvements, and/or substantial equivalents. Some specific examples of potential alternatives, modifications, or variations in the described disclosure are provided below.

The present disclosure may be implemented in various forms, and may be implemented in the form of, for example, a sewing machine system, a sewing machine program, a non-transitory computer-readable medium storing a sewing machine program, and a method of controlling a sewing machine. The sewing machine 1 may include or may not include at least the embroidery device 140 configured to move the embroidery frame in the front-rear direction and the left-right direction, the auxiliary device 170 or 200, or the wide table 3, 7, 500 or 600. The sewing machine 1 may be configured such that at least one wide table is attachable, and a wide table may be attachable to one side of the bed 10 in the short direction D1. The sewing machine 1 may be configured such that at least one auxiliary device is attachable, and the configuration of the auxiliary device that is attachable may be changed as appropriate. The sewing machine 1 may not include the embroidery device 140 and the holder 143 to which the embroidery frame 150 is attachable, and may perform sewing by moving the sewing workpiece by the feed dog 17. The sewing machine 1 may be a sewing machine dedicated to embroidery sewing that does not include the feed dog 17. The LCD 21 may be any display configured to display an image, and may be, for example, organic EL displays, plasma displays, plasma tube array displays, or electronic paper displays using electrophoresis. The LCD 21 may be omitted as appropriate.

The shape and configuration of the bed 10 may be changed as appropriate. The sewing machine 1 may include the first mount portion 130 at either one of the first side plates 111 and 113. The first mount portion 130 may include an engagement protrusion that engages with an engagement hole of an auxiliary device. The sewing machine 1 may include either one of the second mount portion 131 provided on the second side plate 121 and the second mount portion 132 provided on the second side plate 122. The configuration of the wide tables 3, 7, 500, and 600 may be changed as appropriate. For example, the configuration, shape, number, and arrangement of the legs may be changed as appropriate or may be omitted. The sewing machine 1 may include a second mount portion for attaching the wide table on the rear surface of the bed 10 by a configuration that uses a similar magnet to that of the wide table 600. The wide table may be box-shaped, and the legs may be omitted. The legs may not be supported to be pivotable between the storage position and the use position. The legs may be detachably fixed to the table plate. At least the second mount portion 131 or 132 may include an engagement protrusion that engages with an engagement hole of the wide table. At least the cover 69 of the second mount portion 131 or the cover 62 of the second mount portion 132 may be omitted, or may be supported pivotably at the upper side, the left side, or the right side of the corresponding engagement edge. At least the cover 69 of the second mount portion 131 or the cover 62 of the second mount portion 132 may not be urged by a spring. The cover 69 of the second mount portion 131 and the cover 62 of the second mount portion 132 may be detachably attached to the corresponding engagement edges.

At least the second mount portion 131 or 132 may be disposed leftward of the first mount portion 130 in the longitudinal direction D2. The first lever 35, the second lever 34, and the levers 59 and 84 may be appropriately changed in shape and arrangement, and for example, may be disposed farther in the second direction N2 than the center in the longitudinal direction D2 of the corresponding table plate. For example, the shape and arrangement of the hook 85, the first hook 37, and the second hook 36 may be appropriately changed, or may be appropriately omitted. The first lever 35 and the second lever 34 may not be bilaterally symmetrical to each other. The shapes of the first inclined portion 39, the second inclined portion 38, and the inclined portions 86 and 536 may be appropriately changed or may be omitted. The shapes and the arrangements of the second protrusion 461 and the first protrusion 462 may be appropriately changed or may be omitted. The wide table 7 may include a protrusion that contacts an end portion of the lever 84 in the detachment direction J2 when the lever 84 is at the normal position and the wide table 7 is moved in the second direction N2 with respect to the bed 10, the protrusion protruding downward at a position farther in the second direction N2 than the end portion. The wide table 500 may also include a similar protrusion.

The shape, number, and arrangement of the second magnets 606 and 607 may be changed as appropriate. The shape, number, and arrangement of the first magnets 631 and 632 may be changed as appropriate. For example, the number of the second magnets may be one, or three or more. In a case where the wide table includes a plurality of second magnets, the magnetic fields generated by the adjacent second magnets may be different from each other or may be the same as each other. The same applies to the first magnets provided at the sewing machine 1. Each of the short direction D1, the longitudinal direction D2, the first direction N1, and the second direction N2 may be changed in accordance with the configuration of the sewing machine 1.

The program including the command for executing the main process of FIG. 20 may be stored in a memory of each apparatus by the time the CPU 75 executes the program. Thus, the method of acquiring the program, the path of acquiring the program, and the device that stores the program may be changed as appropriate. The program executed by the CPU 75 may be received from another apparatus via a cable or wireless communication and stored in a memory such as a storage. The other apparatuses include, for example, a PC and a server connected via a network.

The steps of the main process are not limited to the example of being executed by the CPU 75, and a part or all of the steps may be executed by another electronic device (for example, an ASIC). The steps of the main process may be processed in a distributed manner by a plurality of electronic devices (for example, a plurality of CPUs). The order of the steps of the main process may be changed, and steps may be omitted or added as necessary. The following changes may be made to the main process as appropriate.

In the sewing machine 1, a part or all of the main process may be omitted. The sewing machine 1 may acquire the type of the embroidery frame that is attached to the holder 143 based on an input result of the user in S2. In the sewing machine 1, the CPU 75 may output a message to an external device in at least S4 or S8, and the message may be output by the external device. The CPU 75 may output a message or a warning by sound or voice in at least S4 or S8. At least S4 or S8 may be omitted, and the sewing may be stopped after the processing of S8. The CPU 75 may be configured not to output a warning when it is detected that at least the wide table 3 or 7 is attached. The processing of S3 may be omitted, and the CPU 75 may perform control such that sewing is performed at the second speed when it is detected that at least the wide table 3 or 7 is attached, regardless of the size of the embroidery frame attached to the holder 143. The CPU 75 may change the sewing speed such that the larger the area on which the sewing workpiece is placed, the faster the sewing speed. More specifically, the CPU 75 may change the sewing speed among a case where the wide table 3 is attached, a case where the wide table 7 is attached, and a case where both the wide tables 3 and 7 are attached.

The above modifications may be combined as appropriate. In addition to the combinations exemplified above, aspects combined with each other without departing from the scope of the present disclosure and without causing contradiction are also included in the scope of the present disclosure.

What is claimed is:

1. A sewing machine comprising:

a bed including:

a bed surface extending horizontally;

a first side plate extending downward from a part of an outer periphery of the bed surface, the first side plate crossing a longitudinal direction of the bed surface;

a second side plate extending downward from another part of the outer periphery of the bed surface, the second side plate crossing a short direction of the bed surface;

a first mount portion to which an auxiliary device is attachable, the first mount portion being provided at the first side plate, the auxiliary device including a first extension surface extending horizontally; and a second mount portion to which a wide table is attachable, the second mount portion being provided at the second side plate, the wide table including a second extension surface extending horizontally, the wide table having a different shape from the auxiliary device; and an embroidery device to which an embroidery frame is attachable, the embroidery device including a holder movable horizontally, the embroidery device being the auxiliary device attached to the first mount portion of the bed, wherein, in a state where the wide table is attached to the second mount portion, the second extension surface, the bed surface, and the first extension surface are located below the embroidery frame.

2. The sewing machine according to claim 1, further comprising the wide table detachably attached to the second mount portion of the bed, the wide table including a table plate including the second extension surface.

3. A sewing machine comprising:

a bed including:

a bed surface extending horizontally;

a first side plate extending downward from a part of an outer periphery of the bed surface, the first side plate crossing a longitudinal direction of the bed surface;

a second side plate extending downward from another part of the outer periphery of the bed surface, the second side plate crossing a short direction of the bed surface;

a first mount portion to which an auxiliary device is attachable, the first mount portion being provided at the first side plate, the auxiliary device including a first extension surface extending horizontally; and a second mount portion provided at the second side plate, the second mount portion including an engagement edge defining an opening formed in the second side plate; and a wide table detachably attached to the second mount portion, the wide table including a table plate including a second extension surface extending horizontally, the wide table having a different shape from the auxiliary device, wherein the wide table includes a lever protruding from the table plate in an insertion direction, the insertion direction being one direction along the short direction, the lever being supported by the table plate; and wherein the lever is inserted into the opening in the insertion direction and the lever engages with the second mount portion, thereby causing the wide table to be attached to the bed.

4. The sewing machine according to claim 1, further comprising:

a pillar extending in an upper-lower direction and connected to the bed, wherein the second mount portion is disposed between the first mount portion and the pillar in the longitudinal direction.

5. The sewing machine according to claim 3, wherein the bed includes a cover configured to close the opening in a case where the wide table is not attached to the bed.

6. The sewing machine according to claim 5, wherein the cover is supported by the bed so as to be pivotable between a closed position at which the opening is closed and an open position at which the opening is open; and wherein the cover is configured to pivot from the closed position to the open position by being pushed by the lever in the insertion direction when the wide table is attached to the bed.

7. The sewing machine according to claim 3, wherein the lever includes a hook protruding in a first direction, the first direction being one direction along the longitudinal direction, a second direction being an opposite direction along the longitudinal direction;

wherein the lever is supported by the table plate so as to be pivotable between a normal position and an attachment-detachment position at which the hook is located farther in the second direction than the normal position; and wherein the lever is inserted into the opening in the insertion direction and then the lever pivots from the attachment-detachment position to the normal position, thereby causing the hook to engage with the second mount portion.

8. The sewing machine according to claim 7, wherein the lever includes an inclined portion formed between the hook and an end of the lever in the insertion direction, the inclined portion being inclined in the second direction toward the insertion direction;

wherein the lever pivots from the normal position to the attachment-detachment position by being inserted into the opening while the inclined portion contacts the engagement edge; and wherein the hook of the lever is inserted into the opening in the insertion direction and then the lever pivots from the attachment-detachment position to the normal position, thereby causing the hook to engage with the second mount portion.

9. The sewing machine according to claim 7, further comprising:

a lock release member connected to the lever, the lock release member being supported by the table plate so as to be movable from a first position to a second position, wherein, in a state where the wide table is attached to the bed, the lock release member moves from the first position to the second position and the lever pivots from the normal position to the attachment-detachment position, thereby releasing engagement between the hook and the second mount portion.

10. The sewing machine according to claim 9, further comprising:

a spring configured to urge the lock release member in a direction from the second position toward the first position.

11. The sewing machine according to claim 2, wherein the second mount portion includes an engagement edge defining an opening formed in the second side plate;

wherein the wide table includes a first lever and a second lever protruding from the table plate in an insertion direction, the insertion direction being one direction along the short direction, a first direction being one direction along the longitudinal direction, a second direction being an opposite direction along the longitudinal direction;

wherein the first lever includes a first hook protruding in the first direction, the first lever being supported by the table plate to be pivotable between a first normal position and a first attachment-detachment position at which the first hook is located farther in the second direction than the first normal position;

wherein the second lever includes a second hook protruding in the second direction, the second lever being supported by the table plate to be pivotable between a second normal position and a second attachment-detachment position at which the second hook is located farther in the first direction than the second normal position;

wherein the first lever is inserted into the opening and then the first lever pivots from the first attachment-detachment position to the first normal position, thereby causing the first hook to engage with the second mount portion; and wherein the second lever is inserted into the opening and then the second lever pivots from the second attachment-detachment position to the second normal position, thereby causing the second hook to engage with the second mount portion.

12. The sewing machine according to claim 11, further comprising:

a first protrusion protruding downward at a position farther in the first direction than a first detachment end portion, the first detachment end portion being an end portion of the first lever in a detachment direction which is an opposite direction along the short direction, the first protrusion being configured to contact the first detachment end portion in a case where the first lever is at the first normal position and the wide table is moved in the first direction with respect to the bed; and a second protrusion protruding downward at a position farther in the second direction than a second detachment end portion, the second detachment end portion being an end portion of the second lever in the detachment direction, the second protrusion being configured to contact the second detachment end portion in a case where the second lever is at the second normal position and the wide table is moved in the second direction with respect to the bed.

13. The sewing machine according to claim 9, wherein the wide table includes a leg coupled to the table plate so as to be pivotable about a pivot shaft extending horizontally between a use position at which the leg extends vertically and a storage position at which the leg extends horizontally; and wherein, in a state where the leg is at the storage position, the leg contacts the lever and the lock release member is not movable from the first position to the second position.

14. The sewing machine according to claim 1, further comprising:

a table sensor configured to detect whether the wide table is attached to the second mount portion;

a needle bar; and a controller configured to:

determine whether the wide table is attached to the second mount portion based on a detection result of the table sensor;

in response to determining that the wide table is not attached to the second mount portion, drive the needle bar in an upper-lower direction at a first speed; and in response to determining that the wide table is attached to the second mount portion, drive the needle bar in the upper-lower direction at a second speed faster than the first speed.

15. The sewing machine according to claim 1, further comprising:

a table sensor configured to detect whether the wide table is attached to the second mount portion;

a frame sensor configured to detect a type of the embroidery frame attached to the holder;

a needle bar; and a controller, configured to:

in response to determining that the embroidery frame of a particular size is attached based on a detection result of the frame sensor, notify that the wide table is to be attached to the second mount portion; and in response to determining that the embroidery frame of the particular size is attached based on the detection result of the frame sensor and determining that the wide table is not attached to the second mount portion based on a detection result of the table sensor, output a warning.

16. The sewing machine according to claim 2, wherein the second mount portion includes a first magnet;

wherein the table plate of the wide table includes a second magnet; and wherein the wide table is attached to the bed by magnetic force between the first magnet and the second magnet.

17. A wide table attachable to a sewing machine, the wide table comprising:

a table plate including a table surface extending horizontally;

a leg coupled to the table plate;

a lever protruding from the table plate in an insertion direction, the insertion direction being one direction along a short direction of a bed surface of the sewing machine, the bed surface extending horizontally, the lever including a hook protruding in a first direction, the first direction being one direction along a longitudinal direction of the bed surface, a second direction being an opposite direction along the longitudinal direction, the lever being supported by the table plate so as to be pivotable between a normal position and an attachment-detachment position at which the hook is located farther in the second direction than the normal position, the lever being inserted into an opening of a side plate in the insertion direction, the side plate crossing the short direction and extending downward from an outer periphery of the bed surface, the hook being engageable with a mount portion including an engagement edge by pivoting from the attachment-detachment position to the normal position, the engagement edge defining the opening of the sewing machine; and a lock release member connected to the lever, the lock release member being supported by the table plate so as to be movable from a first position to a second position, the lock release member being configured to, when moved from the first position to the second position, cause the lever to move from the normal position to the attachment-detachment position and release engagement between the hook and the mount portion.

18. The wide table according to claim 17, wherein the lever includes an inclined portion formed between the hook and an end of the lever in the insertion direction, the inclined portion being inclined in the second direction toward the insertion direction;

wherein the lever pivots from the normal position to the attachment-detachment position by being inserted into the opening while the inclined portion contacts the engagement edge; and wherein the hook of the lever is inserted into the opening in the insertion direction and then the lever pivots from the attachment-detachment position to the normal position, thereby causing the hook to engage with the mount portion.

19. The wide table according to claim 17, further comprising:

a leg coupled to the table plate so as to be pivotable about a pivot shaft extending horizontally between a use position at which the leg extends vertically and a storage position at which the leg extends horizontally; and wherein, in a state where the leg is at the storage position, the leg contacts the lever and the lock release member is not movable from the first position to the second position.

20. The sewing machine according to claim 3, further comprising:

a table sensor configured to detect whether the wide table is attached to the second mount portion;

an embroidery device to which an embroidery frame is attachable, the embroidery device including a holder movable horizontally, the embroidery device being the auxiliary device attached to the first mount portion of the bed;

a frame sensor configured to detect a type of the embroidery frame attached to the holder;

a needle bar; and a controller, wherein, in a state where the wide table is attached to the second mount portion, the second extension surface, the bed surface, and the first extension surface are located below the embroidery frame; and wherein the controller is configured to:

in response to determining that the embroidery frame of a particular size is attached based on a detection result of the frame sensor, notify that the wide table is to be attached to the second mount portion; and in response to determining that the embroidery frame of the particular size is attached based on the detection result of the frame sensor and determining that the wide table is not attached to the second mount portion based on a detection result of the table sensor, output a warning.

* * * * *